US006647829B1

(12) United States Patent
Youngren et al.

(10) Patent No.: US 6,647,829 B1
(45) Date of Patent: Nov. 18, 2003

(54) STRIKING TOOL WITH WEIGHT FORWARD HEAD

(75) Inventors: Robert H. Youngren, Rockford, IL (US); Daniel M. Eisman, Rockford, IL (US); Daniel Loveland, Roscoe, IL (US); Christopher Aiston, Nashua, NH (US); Jack Harkins, Hollis, NH (US)

(73) Assignee: Estwing Manufacturing Company, Rockford, IL (US)

( * ) Notice: Subject to any disclaimer, the term of this patent is extended or adjusted under 35 U.S.C. 154(b) by 0 days.

(21) Appl. No.: 10/214,237

(22) Filed: Aug. 7, 2002

(51) Int. Cl.[7] ..... B25D 1/00
(52) U.S. Cl. ..... 81/20; 30/308.1; 254/26 R
(58) Field of Search ..... 81/20, 22, 26; 30/308, 308.1, 340; 254/26 R

(56) References Cited

U.S. PATENT DOCUMENTS

| | | | |
|---|---|---|---|
| 1,934,706 | A | 11/1933 | Green |
| 3,792,725 | A | 2/1974 | Burgeson |
| 3,870,091 | A | 3/1975 | Burgeson |
| 3,874,433 | A | 4/1975 | Shepherd, Jr. et al. |
| 4,030,847 | A | 6/1977 | Carmien |
| 4,038,719 | A | 8/1977 | Bennett |
| 4,154,273 | A | 5/1979 | Pollak |
| 4,363,344 | A | 12/1982 | Pollak |
| 4,639,029 | A | 1/1987 | Kolonia |
| 5,123,303 | A | 6/1992 | Lee et al. |
| 5,259,274 | A | 11/1993 | Hreha |
| 5,425,176 | A | 6/1995 | Brainerd et al. |
| 5,588,343 | A | 12/1996 | Rust et al. |
| 5,657,674 | A | 8/1997 | Burnett |
| 5,768,956 | A | 6/1998 | Coonrad |
| 5,860,334 | A | 1/1999 | Coonrad |
| 5,906,144 | A | 5/1999 | Staviski et al. |
| 5,988,019 | A | 11/1999 | Coonrad |
| 5,996,235 | A | 12/1999 | Brainerd |
| 6,016,722 | A | 1/2000 | Gierer et al. |
| D426,128 | S | 6/2000 | Lamond et al. |
| 6,128,977 | A | 10/2000 | Gierer et al. |
| 6,131,488 | A | 10/2000 | Coonrad |
| D436,821 | S | 1/2001 | Douglas et al. |
| 6,202,511 | B1 | 3/2001 | Murray et al. |
| 6,250,181 | B1 | 6/2001 | Coonrad |
| D449,770 | S | 10/2001 | Chen |
| 6,370,986 | B1 | 4/2002 | Scott |
| 6,405,616 | B1 | 6/2002 | Chen |
| D459,968 | S | 7/2002 | Harkins et al. |
| 6,460,430 | B2 | 10/2002 | Coonrad |
| 2001/0029813 | A1 | 10/2001 | Schroeder |

OTHER PUBLICATIONS

Copy of International Search Report established for PCT/US02/05067.

U.S. patent application Ser. No. 29/159,356, Harkins et al., filed Apr. 18, 2002.

U.S. patent application Ser. No. 29/159,383, Harkins et al., filed Apr. 19, 2002.

Chaffin et al., Eds., "Hand–Tool Design Guidelines," in: *Occupational Biomechanics*, Ch. 11, pp. 435–461, 3rd Edition, John Wiley & Sons, Inc. (New York, 1999).

(List continued on next page.)

*Primary Examiner*—James G. Smith
(74) *Attorney, Agent, or Firm*—Gardner Carton & Douglas LLP

(57) ABSTRACT

The present invention provides a hand-held striking tool that has a head disposed forward of the centerline of a handle. The hand-held striking tool of the present invention may further include a flange positioned beneath the head of the tool, the flange functioning as a second area of contact so that the effect of overstrike may be controlled. The present invention also provides a hand-held striking tool that isolates the striking head of the tool from the handle such that the effect of vibrations caused by using the tool are reduced.

6 Claims, 34 Drawing Sheets

OTHER PUBLICATIONS

Knowlton et al., "Ulnar Deviation and Short–Term Strength Reductions as Affected by a Curve–Handled Ripping Hammer and a Conventional Claw Hammer," *Ergonomics*, 26 (2), 173–179 (1983).

Konz, "Bent Hammer Handles," *Human Factors*, 28 (3), 317–323 (1986).

"RIDGID Robohammer®," in *Woodworking Tools for a Lifetime*, Web page: http://www.ridgidwoodworking.com/products_robohammer.phtml, No date.

STRIKING TOOL WITH WEIGHT FORWARD HEAD

FIELD OF THE INVENTION

The present invention relates to hand-held striking tools. The present invention further relates to hammers, axes and hatchets.

BACKGROUND

Hand-held striking tools are principally designed to deliver a blow to an object. Such tools are designed to drive nails, in the case of hammers, or chop and split wood in the cases of hatchets and axes. There are specialty impact tools, such as roofing striking tools, which have the physical characteristics of both a conventional striking tool and a conventional hatchet. There are also other specialty striking tools that are designed to perform specific functions, typically, when applied to the building trades.

The striking tools of the prior art share several common features. Typically, such prior art devices do not significantly insulate a user from the vibrations that result when the head of the hand-held impact tool strikes a surface. Also, the weight centerline of the head is approximately at the centerline of the shank of the prior art striking tool, such that the striking tool will balance vertically when held in a hand.

One prior art device employed a steel head forged separately of a solid steel handle in an attempt to provide a striking tool having good shock absorbing characteristics and a reduced manufacturing cost. Another prior art device employed a spring shank disposed between a striking tool's handle and head in an attempt to absorb the shock that occurred with use. Yet another prior art device employed beams, which were parallel to a core about which a handle was formed, the beams residing in over-sized holes to purportedly function as shock absorbers.

Also, the spatial relationship of the head to the handle of hand-held impact tools has remained virtually unchanged for decades. While the prior art has attempted to address vibration reduction, the prior art has generally not addressed the energy required to yield such devices. The prior art has similarly not addressed ways to manage overstrike. Overstrike occurs when, for example, the striking surface of a striking tool misses a nail and the handle strikes the wood or other surface. Thus, the shape of hand-held impact tools has remained, for the most part, unchanged.

The shank, or upper portion of the handle, is characteristically straight in most striking tools of the prior art. As discussed above, many striking tools of the prior art are weight-balanced when held vertically in a human hand such that the striking tools do not tip under their own weight. Thus, even in cases where the handle or shank of a prior art striking tool is not completely straight, such as where the handle is bent or disposed at an angle, the tool will be weight-balanced.

It would therefore be an advantage to have a hand-held striking tool that significantly reduces the effect of vibrations arising during use. It would be a further advantage to have a hand-held striking tool that better utilizes a user's energy. It would be yet another advantage to have a hand-held striking tool that manages the effect of overstrike.

SUMMARY OF THE INVENTION

Embodiments of the present invention provide a hand-held striking tool that significantly reduces the effect of vibrations arising during use. Embodiments of the present invention further provide a hand-held striking tool that better utilizes a user's energy. Embodiments of the present invention also provide a hand-held striking tool that manages the effect of overstrike.

One embodiment of the present invention provides a striking tool that includes a handle, a grip molded onto the handle, a generally curved shank connected to the handle, and a head connected to the shank, the head having a striking surface. The head defines a weight center. The handle may further include an elastomeric gasket that is positioned between the shank and the head. A pultruded rod may be positioned within the shank and the handle to provide additional strength to the striking tool.

Another embodiment of the present invention provides a striking tool that includes a handle, a grip molded onto the handle, a generally curved shank connected to the handle, and a head connected to the shank, the head having a striking surface. The head defines a weight center. The head includes an overstrike flange, the overstrike flange providing an area of contact should the striking surface hit beyond its target. The head may include a nail-pulling end that is distal to the striking surface. The head may further be generally curved to facilitate the function of the nail-pulling end. The handle may further include an elastomeric gasket that is positioned between the shank and the head. A pultruded rod may be positioned within the shank and the handle to provide additional strength to the striking tool.

The present invention also provides a hand-held striking tool having a reduced vibrational Shock Factor when compared to a hammer of the prior art. The hammer of this embodiment includes a handle, a grip molded onto the handle, a generally curved shank connected to the handle, and a head connected to the shank, the head having a striking surface. The head defines a weight center. The head includes an overstrike flange, the overstrike flange providing an area of contact should the striking surface hit beyond its target. The head may include a nail-pulling end that is distal to the striking surface. The head may further be generally curved to facilitate the function of the nail-pulling end. The handle may further include an elastomeric gasket that is positioned between the shank and the head. A pultruded rod may be positioned within the shank and the handle to provide additional strength to the striking tool.

Still another embodiment of the present invention provides a method for making a hand-held striking tool having a reduced vibrational Shock Factor when compared to a hammer of the prior art. The method includes the steps of making a handle having a generally curved shape, molding a grip onto the handle, making a generally curved shank, connecting the shank to the handle or alternatively making the shank integral to the handle, making a head, the head having a striking surface, and connecting the head to the shank. The head defines a weight center. The shank may be adapted so that a connection region of the head slides into a groove or slot in the shank. The groove of the shank may include a resilient gasket interposed between the head and the shank. The shank and head may be further adapted to be connected using fasteners such as bolts. In an alternative embodiment, the method can include making the shank integral to the handle, and connecting the shank to the head.

One embodiment of the present invention provides a striking tool that includes a handle, a grip molded onto the handle, a generally curved shank connected to the handle, and a head connected to the shank, the head having a striking surface. The head defines a weight center. The head includes an overstrike flange, the overstrike flange providing an area of contact should the striking surface hit beyond its target. A horizontal plane is defined as the plane on which the striking tool rests when laid flat on its side, such as when laid on a tabletop. A first cutting plane divides the cutting tool along the length of the striking tool. The first cutting plane is perpendicular to the horizontal surface of the striking tool, and a line which is intersected by the first cutting plane is defined by a first point positioned along a center line of the handle and a second point positioned along the center line of the handle, the second point being vertically 2 inches up the handle as measured from the first point, the first point being separated by a vertical distance of 2 inches from a bottommost point, the bottommost point being defined by a bottom edge of the handle, and the bottommost point is intersected by a line that is parallel to the first cutting plane. A second cutting plane which is perpendicular to the first cutting plane and also perpendicular to the horizontal surface is disposed 2 inches down from a second center point, the second center point being defined by a top edge of the head of the striking tool. The second cutting plane defines a head portion, which is further divided by the first cutting plane into a first region and a second region. The first region is proximal to the striking surface and includes the striking surface, and the second region is distal to the striking surface and includes a claw.

In another embodiment, the weight of the first region is at least 70% of the sum of the weights of the first and second regions. In yet another embodiment, the weight of the first region is at least 7% of the sum of the weights of the first and second regions. In yet another embodiment, the weight of the first region is between 75 to 90% of the sum of the weights of the first and second regions.

DETAILED DESCRIPTION

Figure 1:
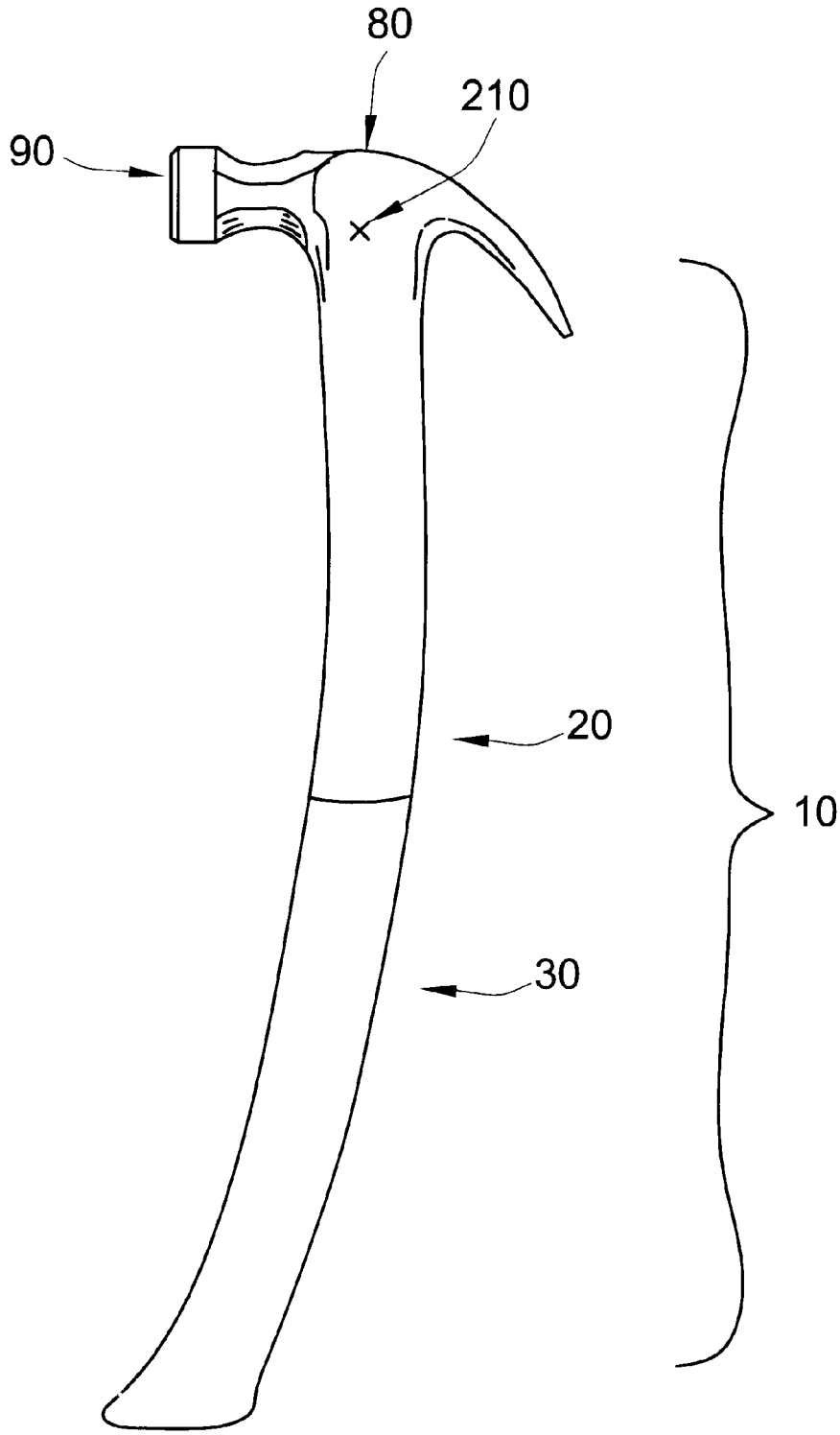
FIG. 1 illustrates a striking tool made according to the principles of the present invention.

With reference to FIG. 1, there is provided according to one embodiment of the present invention a striking tool 10. The striking tool 10 includes a head 80 that includes a striking surface 90. The head may be metallic or made of other material useful for a striking tool head. For example, the head may be made of metal such as carbon steel and the like. Alternatively, the head may be made of a composite material. The striking tool 10 includes a curved handle 30 and a curved shank 20. The curved handle 30 and the curved shank 20 are adapted to be connected, one to the other. In an alternative embodiment, the curved handle 30 and the curved shank 20 are integrally formed so as to provide a unitary piece. The curved shank 20 and the head 80 are adapted to be attached, one to the other. The curved handle 30 and the curved shank 20 are generally curved so that the weight center 210 is positioned between the curved longitudinal centerline projected to bisect the head 80 (not shown) and the striking surface 90, creating an imbalance in the striking tool 10 when it is held by a human hand. Thus, the weight center 210 is forward of the longitudinal centerline (not shown). The imbalance tends to cause the striking tool 10 to pitch forward toward the surface to be struck when held nearly vertically in the hand. Weight center 210 is effectively positioned forward of a human hand (not shown) grasping curved handle 30. This weight-forward design provides numerous advantages, one being the ability to deliver a more efficient blow. In laboratory tests, nails have been driven into wood with one blow of the striking tool 10 of the present invention. In an alternative embodiment, the handle 30 may be angled or offset. In another alternative embodiment, the shank 20 may be angled or offset.

Figure 1A:
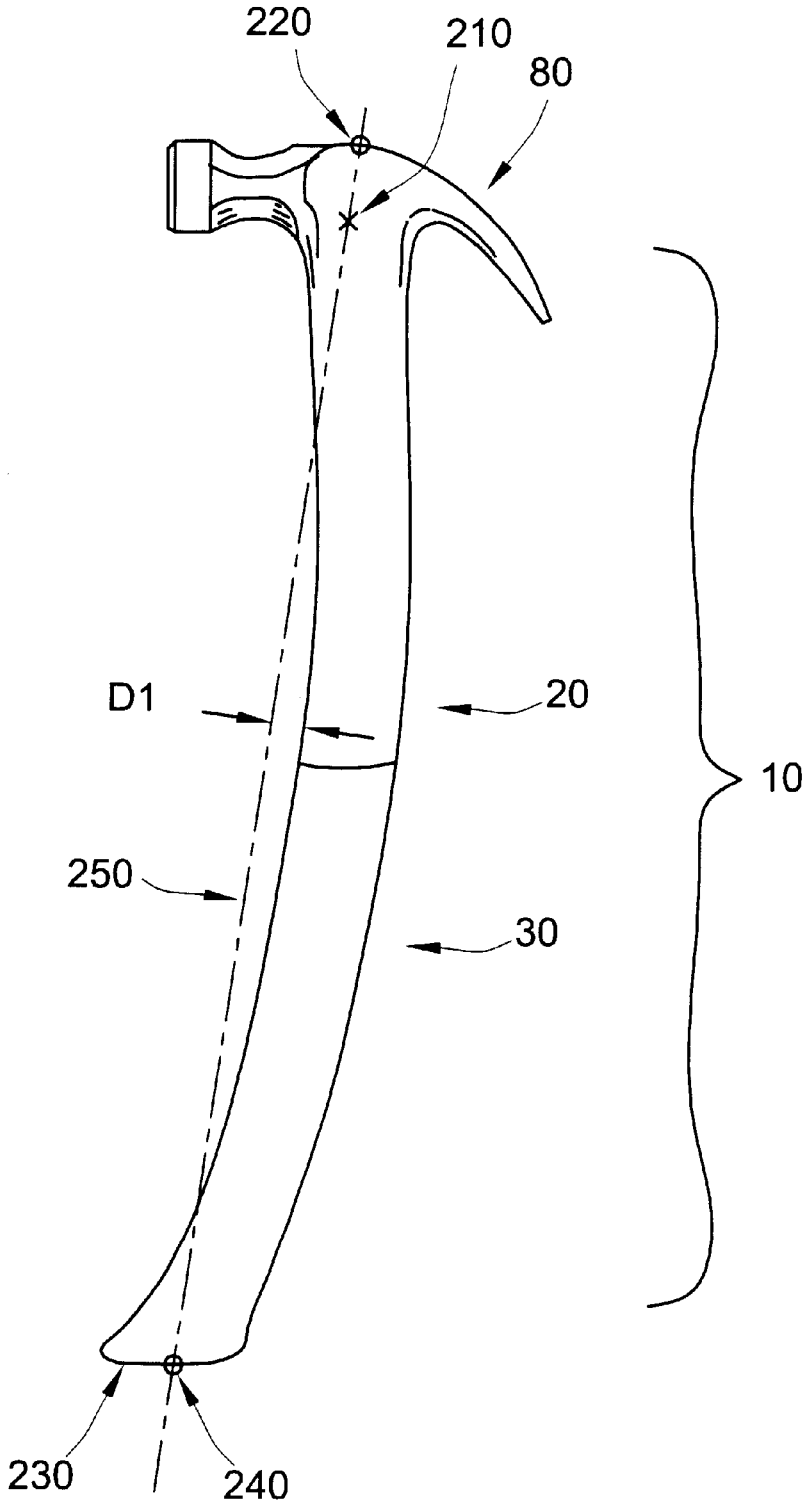
FIG. 1*a* illustrates a striking tool of the present invention depicting a weight forward distance D1.

With reference to FIG. 1*a*, there is provided according to one embodiment of the present invention a striking tool 10. The striking tool 10 includes a head 80, a curved handle 30 and a curved shank 20. The curved handle 30 and the curved shank 20 are adapted to be connected, one to the other. In an alternative embodiment, the curved handle 30 and the curved shank 20 are integrally formed so as to provide a unitary piece. The curved shank 20 and the head 80 are adapted to be attached, one to the other. The bottom surface of handle 30 defines a bottom edge 230. The bottom edge 230 defines a center point 240. The striking tool 10 defines a weight center 210 and further defines a point 220 that is a projection of the weight center onto the surface of head 80. Center point 240 and weight center projection point 220 define a line 250. A distance D1 is defined as the maximum distance between handle 30 or shank 20 and line 250. Because of the generally curved shape of the striking tool 10, distance D1 defines a gap.

Figure 1B:
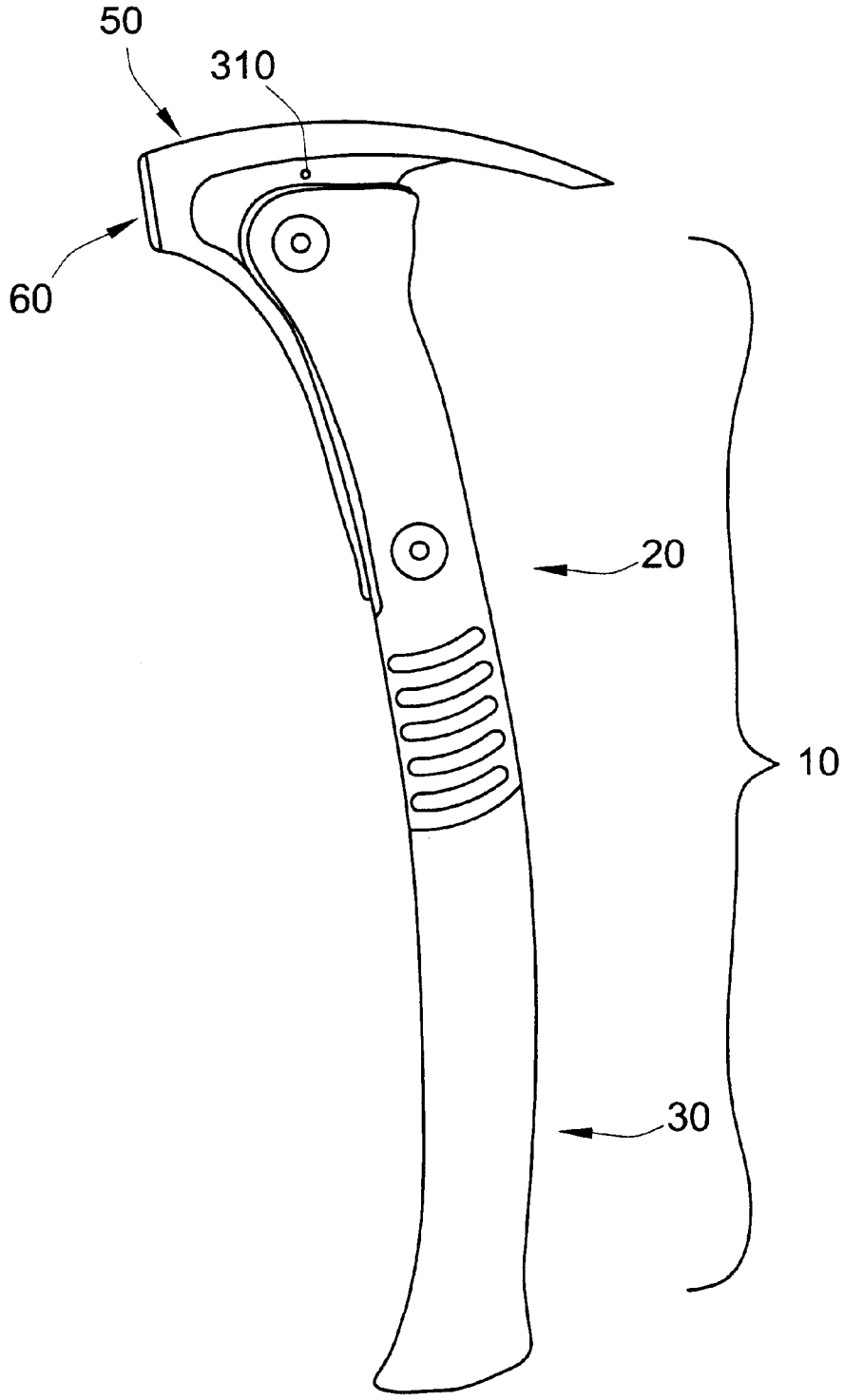
FIG. 1*b* illustrates a striking tool made according to an alternative embodiment of the present invention.

In another embodiment of the present invention, FIG. 1*b* is an elevation view of a striking tool 10. The striking tool 10 includes a head 50 that includes a striking surface 60. The head 50 defines a weight center 310. The striking tool 10 includes a curved handle 30 and a curved shank 20. The curved handle 30 and the curved shank 20 are adapted to be connected, one to the other. In an alternative embodiment, the curved handle 30 and the curved shank 20 are integrally formed so as to provide a unitary piece. The curved shank 20 and the head 50 are adapted to be attached, one to the other. The curved handle 30 and the curved shank 20 are generally curved so that the weight center 310 is positioned between a curved longitudinal centerline projected to bisect the head 50 (not shown) and the striking surface 60, creating an imbalance in the striking tool 10 when it is held by a human hand. Thus, the weight center 310 is forward of the longitudinal centerline (not shown). The imbalance tends to cause the striking tool 10 to pitch forward toward the surface to be struck when held nearly vertically in the hand. In other words, the weight center is shifted from approximately the shank or handle centerline, as for a standard prior art striking tool, forward to the new weight center 310 defined by the head 50. When the striking tool 10 is in use, the weight center 310 is effectively positioned forward of a human hand (not shown, see FIG. 8) grasping the curved handle 30. This weight-forward design provides numerous advantages, one being the ability to deliver a more efficient blow. In laboratory tests, nails have been driven into wood with one blow of the striking tool 10 of the present invention. In an alternative embodiment, the handle 30 may be angled or offset. In another alternative embodiment, the shank 20 may be angled or offset.

Figure 1C:
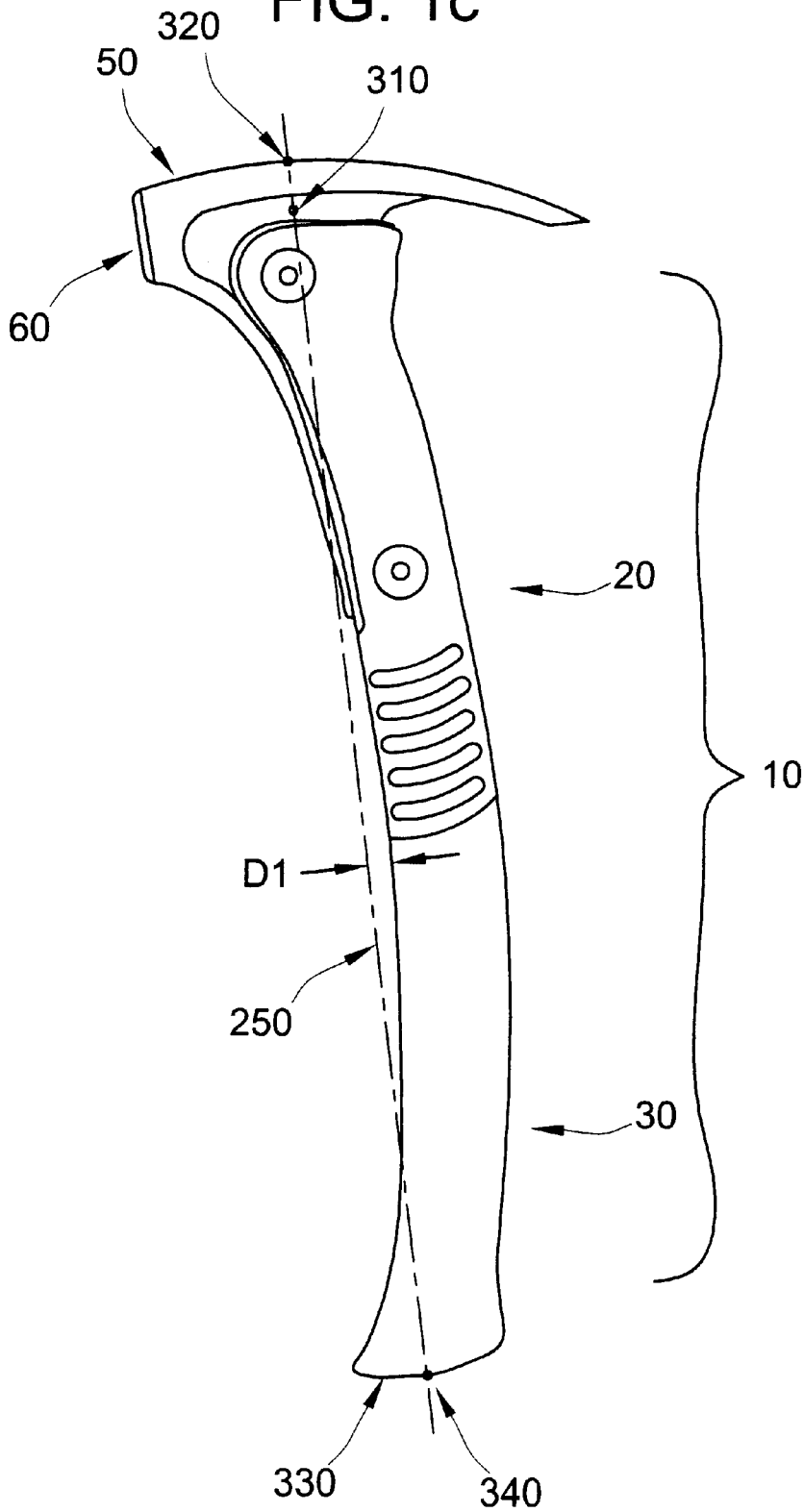
FIG. 1*c* illustrates an alternative embodiment of a striking tool of the present invention depicting a weight forward distance D1.

In another embodiment of the present invention, FIG. 1*c* depicts a striking tool 10. The striking tool 10 includes a head 50, a curved handle 30 and a curved shank 20. The curved handle 30 and the curved shank 20 are adapted to be connected, one to the other. In an alternative embodiment, the curved handle 30 and the curved shank 20 are integrally formed so as to provide a unitary piece. The curved shank 20 and the head 50 are adapted to be attached, one to the other. The bottom surface of handle 30 defines a bottom edge 330. The bottom edge 330 defines a center point 340. The striking tool 10 defines a weight center 310 and further defines a point 320 that is a projection of the weight center onto the surface of head 50. Center point 340 and weight center projection point 320 define a line 250. A distance D1 is defined as the maximum distance between handle 30 or shank 20 and line 250. Because of the generally curved shape of the striking tool 10, distance D1 defines a gap. Distance D1 illustrates that the position of the weight center 310 is forward of a human gripping hand during use (see also FIGS. 8 and 12).

Figure 1D:
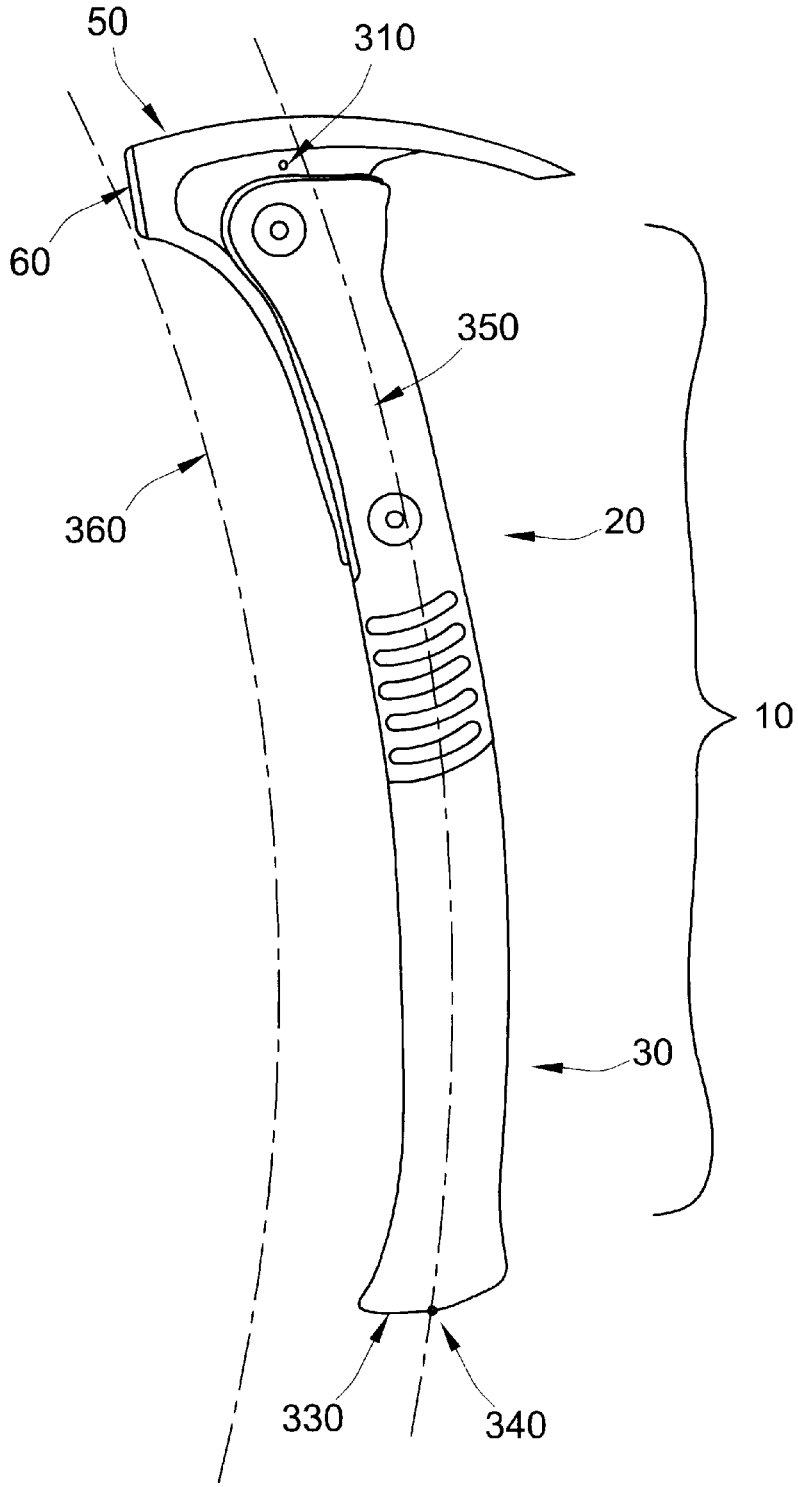
FIG. 1*d* illustrates an alternative embodiment of a striking tool of the present invention depicting a curved centerline and a weight center forward of the centerline.

In another embodiment of the present invention, FIG. 1*d* depicts a striking tool 10. The striking tool 10 includes a head 50 that includes a striking surface 60. The striking tool 10 defines a weight center 310. The striking tool 10 includes a curved handle 30 and a curved shank 20. The curved handle 30 and the curved shank 20 are adapted to be connected, one to the other. In an alternative embodiment, the curved handle 30 and the curved shank 20 are integrally formed so as to provide a unitary piece. The curved shank 20 and the head 50 are adapted to be attached, one to the other. The bottom surface of handle 30 defines a bottom edge 330. The bottom edge 330 defines a center point 340. The curved handle 30 and curved shank 20 together define a curved centerline 350, which intersects center point 340. Alternatively, curved handle 30 can define a centerline, or curved shank 20 can define a centerline. A curved line 360 is parallel to centerline 350 and tangent to the striking surface 60. The weight center 310 is disposed forward of curved centerline 350. In other words, the weight center 310 is disposed between curved centerline 350 and the striking surface 60.

Figure 2:
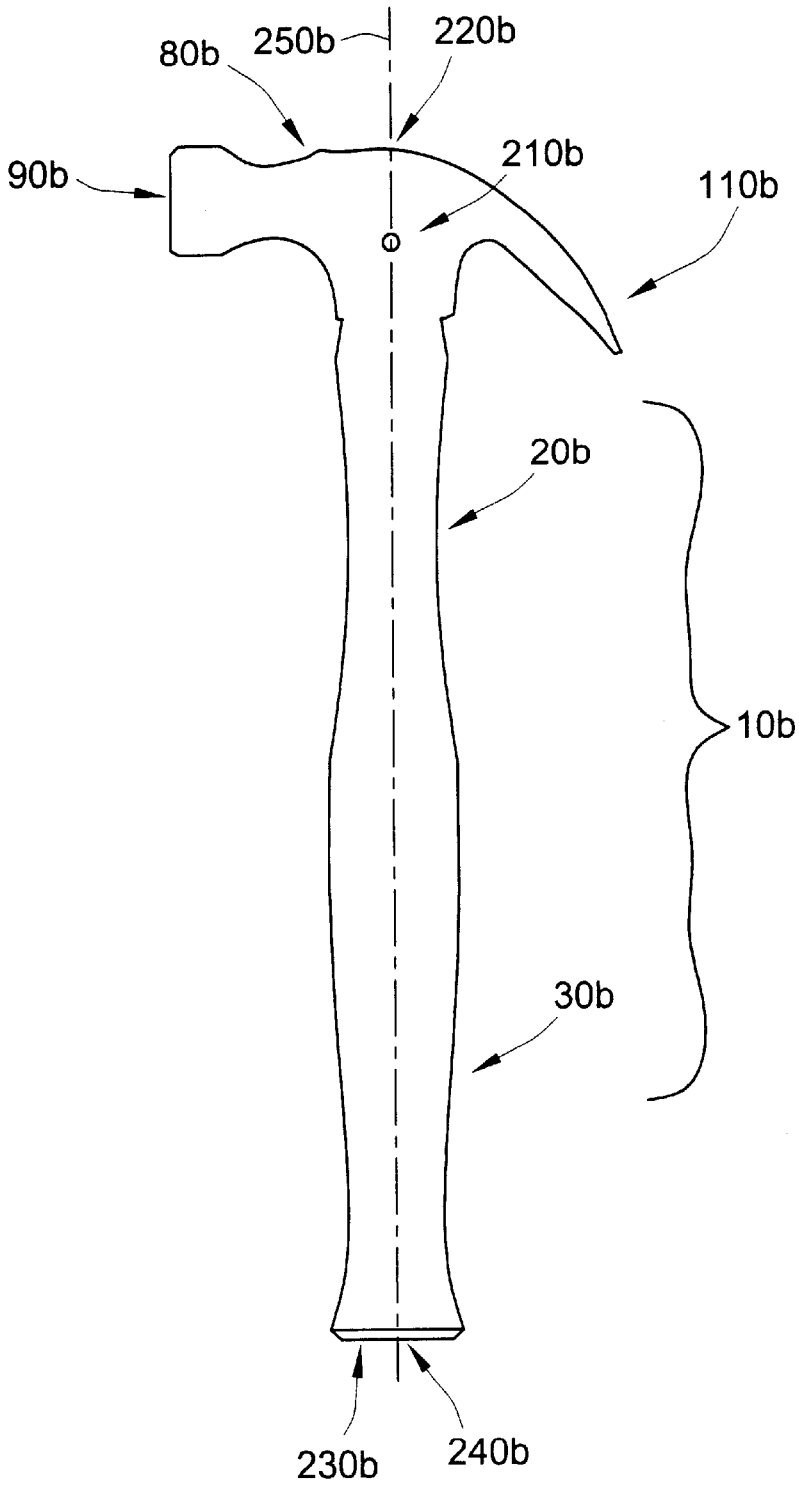
FIG. 2 (PRIOR ART)
FIG. 2 illustrates a striking tool of the prior art.

FIG. 2 depicts a striking tool 10*b* of the prior art. The striking tool 10*b* includes a head 80*b* and a handle 30*b*. The head 80*b* includes a striking surface 90*b* and a claw 110*b*. The handle 30*b* and the head 80*b* are adapted to be attached, one to the other. The handle 30*b* also includes an integral shank 20*b* which is characteristically straight. The projection of the bottom surface of handle 30*b* defines a bottom edge 230*b*. The bottom edge 230*b* defines a center point 240*b*. The striking tool 10*b* defines a weight center 210*b* and further defines a point 220*b* that is a projection of the weight center onto the surface of head 80*b*. Center point 240*b* and weight center projection point 220*b* define a line 250*b* which intersects weight center 210*b*. Line 250*b* is superimposed on the longitudinal centerline of the striking tool 10*b*.

A comparison of the striking tool 10 of the present invention and the striking tool 10*b* of the prior art, in FIGS. 1*c* and 2, respectively, effectively demonstrates the weight forward design of the present invention. Striking tool 10*b* of the prior art does not define a gap between the handle 30*b* or the shank 20*b* and the line 250*b*. In contrast, striking tool 10 of the present invention defines a distance D1, which is the maximum distance between the handle 30 or the shank 20 and line 250, thus providing a gap between the handle 30 or the shank 20 and line 250. This weight forward design provides numerous advantages, one being the ability to deliver a more efficient blow.

Figure 3:
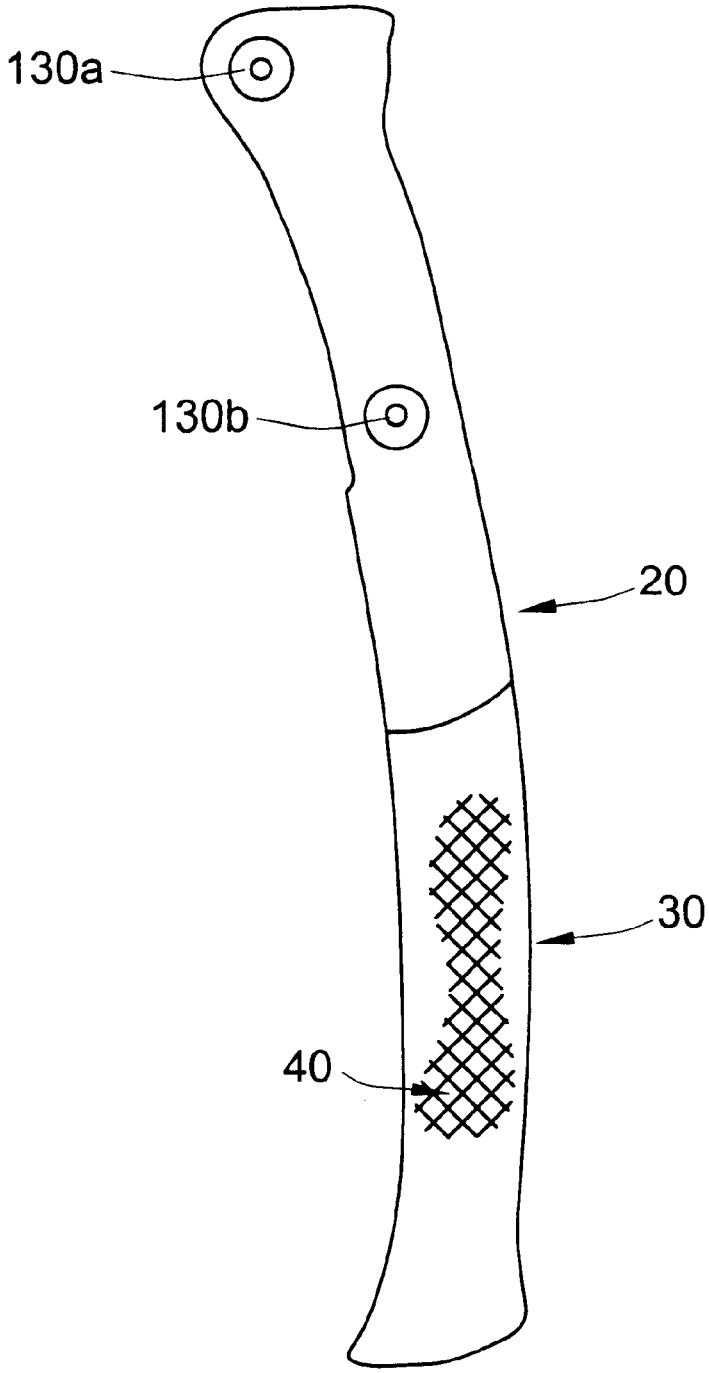
FIG. 3 is an elevation view of a handle of a striking tool of one embodiment of the present invention.

FIG. 3 further illustrates a handle 30 of one embodiment of the present invention. The handle 30 may be curved, angled, or offset. The handle 30 may include a grip 40. The handle 30 is adapted to be connected to a curved shank 20. Curved shank 20 may include fastener openings 130 (a,b), adapted to attach the curved shank 20 to a striking head (not shown). The handle 30 may be manufactured of a single material such that the handle 30 and the grip 40 are one and the same. Alternatively, the handle 30 may be manufactured such that the grip portion 40 is of a different material from that used to manufacture the remainder of the handle 30, where the grip 40 is adapted to encase the handle 30. The grip 40 may be further adapted to attach to the handle 30. As will be recognized by one of ordinary skill in the art, the handle 30 and the curved shank 20 may be manufactured as a unitary piece. However, the handle 30 may be separately manufactured from the curved shank 20 and the handle 30 and the curved shank 20 adapted to be attached, one to the other.

Figure 3A:
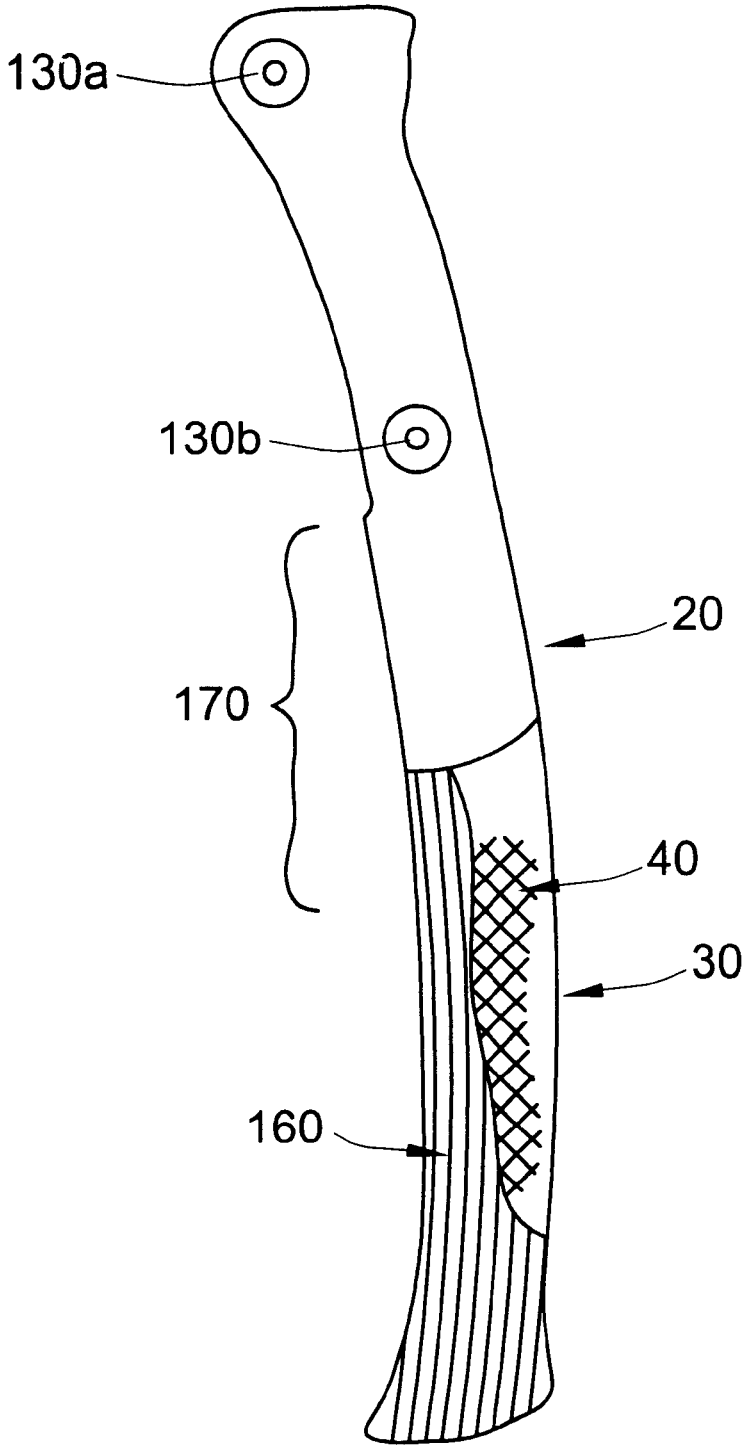
FIG. 3*a* is a sectional view of the handle of FIG. 3.

In an alternative embodiment, illustrated in FIG. 3*a*, a handle 30 may further include a ribbed structure 160. The ribbed structure 160 has a skeletal framework with interstitial spaces adapted to receive a grip 40 so that the grip 40, when attached to the handle 30, is integrally locked into the handle 30. In this embodiment, the handle 30 and a curved shank 20 can be all of one piece, providing an integral shank and handle 170. Alternatively, the handle 30 may be separately manufactured from the curved shank 20 and the handle 30 and the curved shank 20 adapted to be attached, one to the other. Curved shank 20 may include fastener openings 130 (a,b), adapted to attach the curved shank 20 to a striking head (not shown).

Figure 3B:
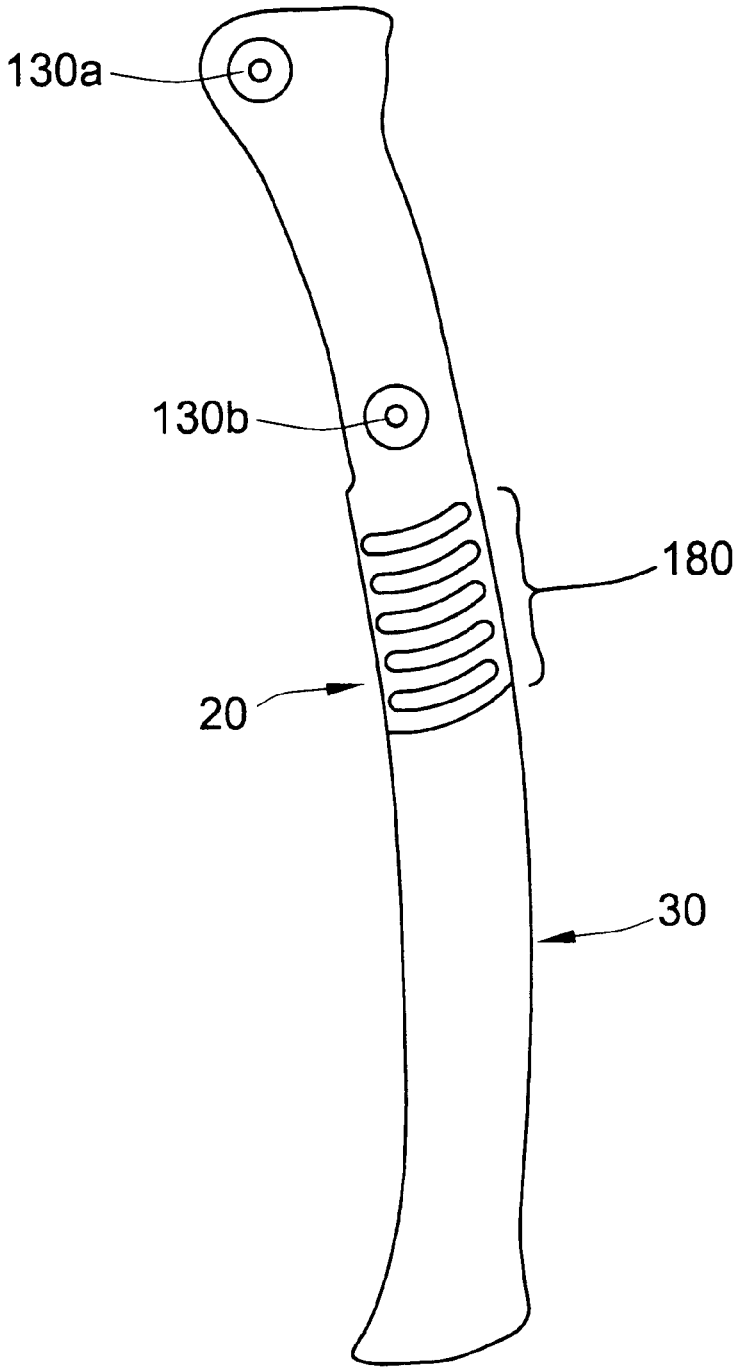
FIG. 3*b* illustrates an alternative embodiment of the handle of FIG. 3.

In an alternative embodiment, illustrated in FIG. 3*b*, a curved shank 20 may further include a grooved structure 180. The curved shank 20 is adapted to be attached to a handle 30, and may be integral with the handle 30. Alternatively, the handle 30 may be separately manufactured from the curved shank 20 and the handle 30 and the curved shank 20 adapted to be attached, one to the other. Curved shank 20 may include fastener openings 130 (a,b), adapted to attach the curved shank 20 to a striking head (not shown).

Figure 4:
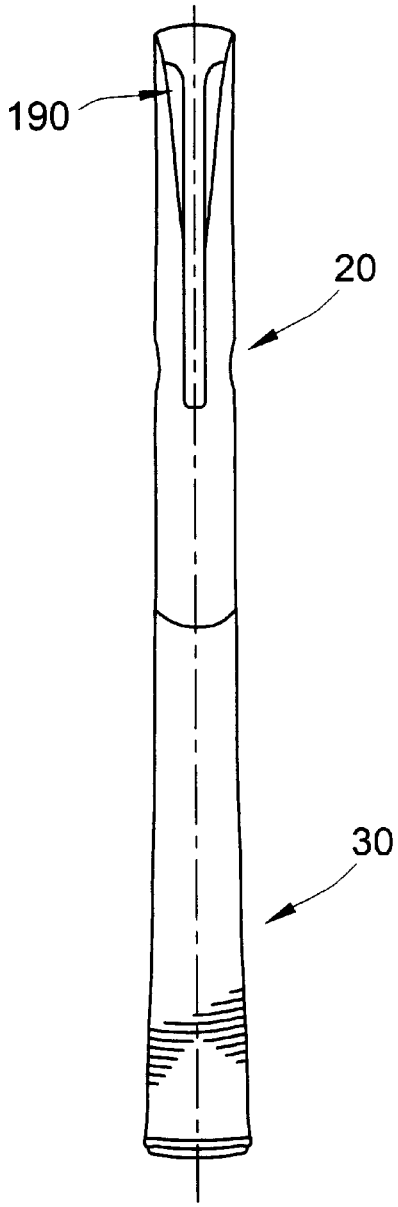
FIG. 4 is a side elevation view of the handle of FIG. 3.

FIG. 4 depicts a front elevation view of a handle 30, which is adapted to be attached to an integral curved shank 20. The curved shank 20 includes a groove surface 190 distal to the end of the handle 30. The groove surface 190 can accept a gasket 300 (not shown, see FIG. 7). Groove surface 190 can be fabricated in various structural orientations so that it can seat an appropriate resilient or elastomeric gasket 300 (not shown).

Figure 4A:
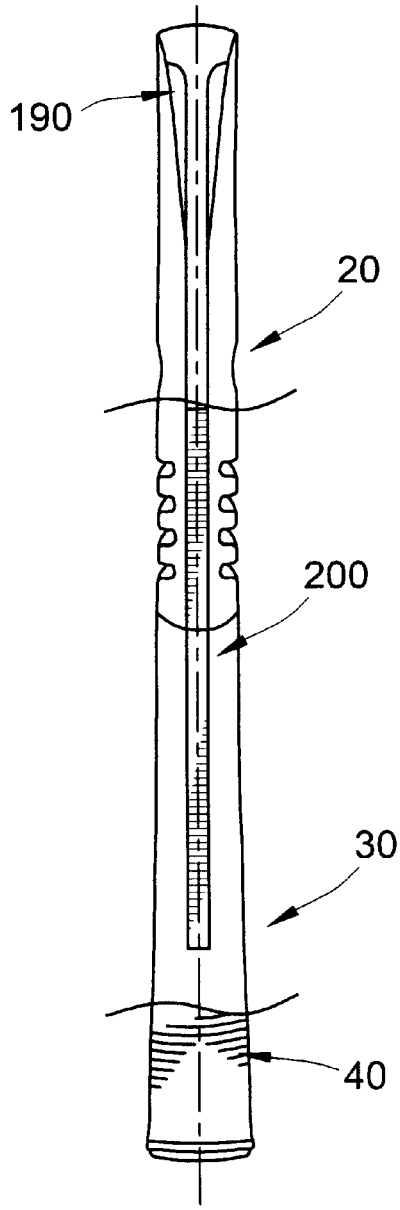
FIG. 4*a* is a sectional view of the handle of FIG. 4.

In an alternative embodiment, illustrated in FIG. 4*a*, a curved shank 20 may be attached to a pultrusion. The pultrusion may be a pultruded rod or shaft 200. The pultruded rod or shaft 200 is encased within an integral curved shank 20 and handle 30. An alternative embodiment includes a pultruded rod or shaft 200 encased in the integral shank and handle 170 depicted in FIG. 3*a*. The pultruded rod 200 consists preferably of a fiberglass pultrusion. In an alternative embodiment, the handle 30 may be separately manufactured from the curved shank 20, one or the other attached to the pultruded rod 200, and the handle 30 and the curved shank 20 adapted to be attached, one to the other. The handle 30 may be manufactured of a single material such that the handle 30 and a grip 40 are one and the same. Alternatively, the handle 30 may be manufactured such that the grip 40 is of a different material from that used to manufacture the remainder of the handle 30, where the grip 40 is adapted to encase the handle 30. The grip 40 may be further adapted to attach to the handle 30.

Figure 5:
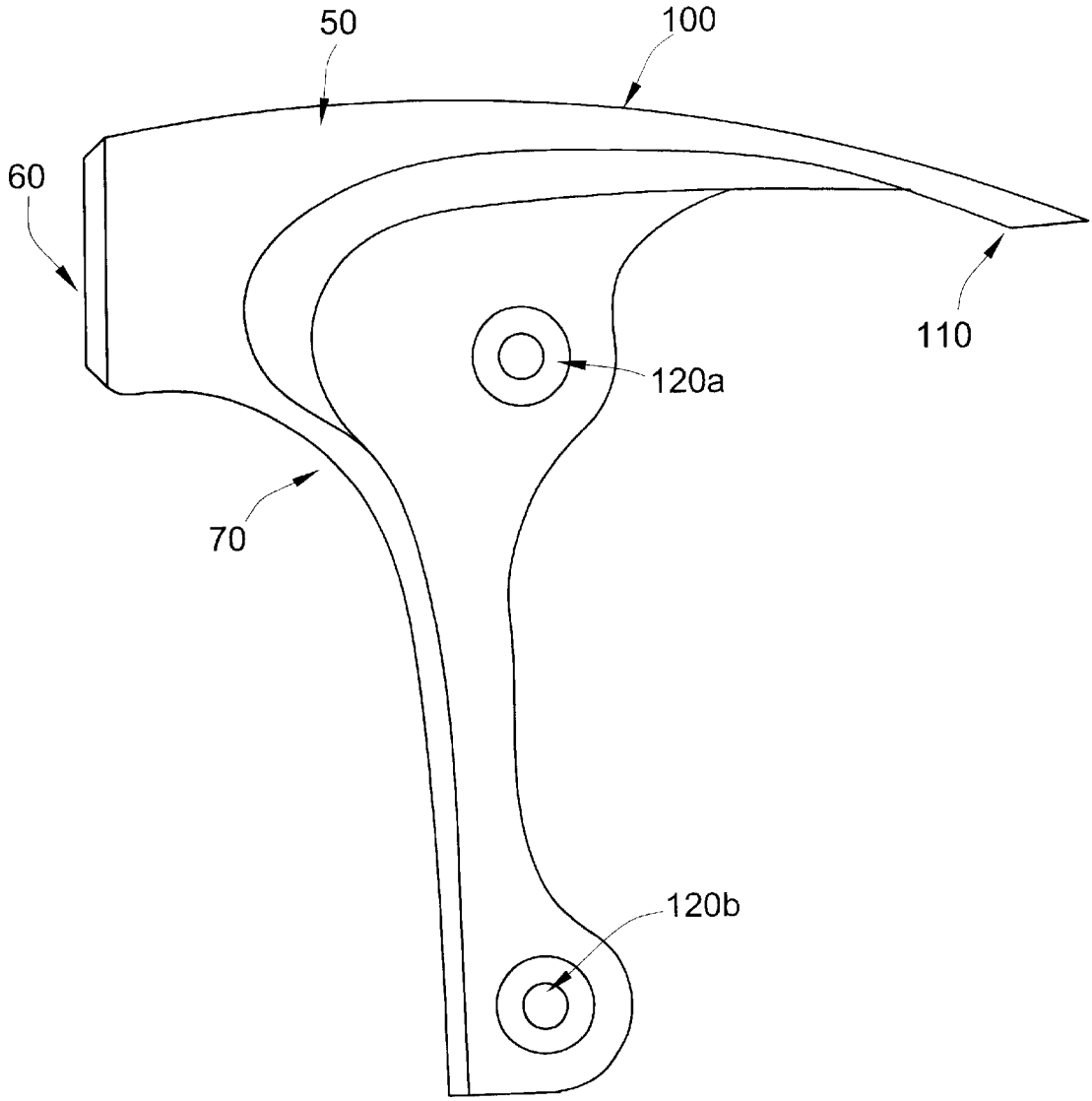
FIG. 5 illustrates the head of a striking tool of one embodiment of the present invention.

FIG. 5 depicts a plan view of a head 50. The head may be forged, cast, or machined. Head 50 has a generally flat striking surface 60. The striking surface 60 can be fabricated in various face shapes, preferably generally square, rectangular, octagonal, or a combination thereof. The head 50 has an overstrike flange 70, which may be curved and which manages the effect of overstrike. Alternatively, overstrike flange 70 may be of other shapes, such as angulated, offset, or discontinuous. Head 50 is provided with a rocker surface 100 which is substantially curved over a continuous radius, terminating in a claw 110. Claw 100 can have various shapes, including a V-shape. Head 50 may include mounting holes 120 (a,b), adapted to fixedly attach head 50 to a curved shank 20 (not shown).

Figure 6:
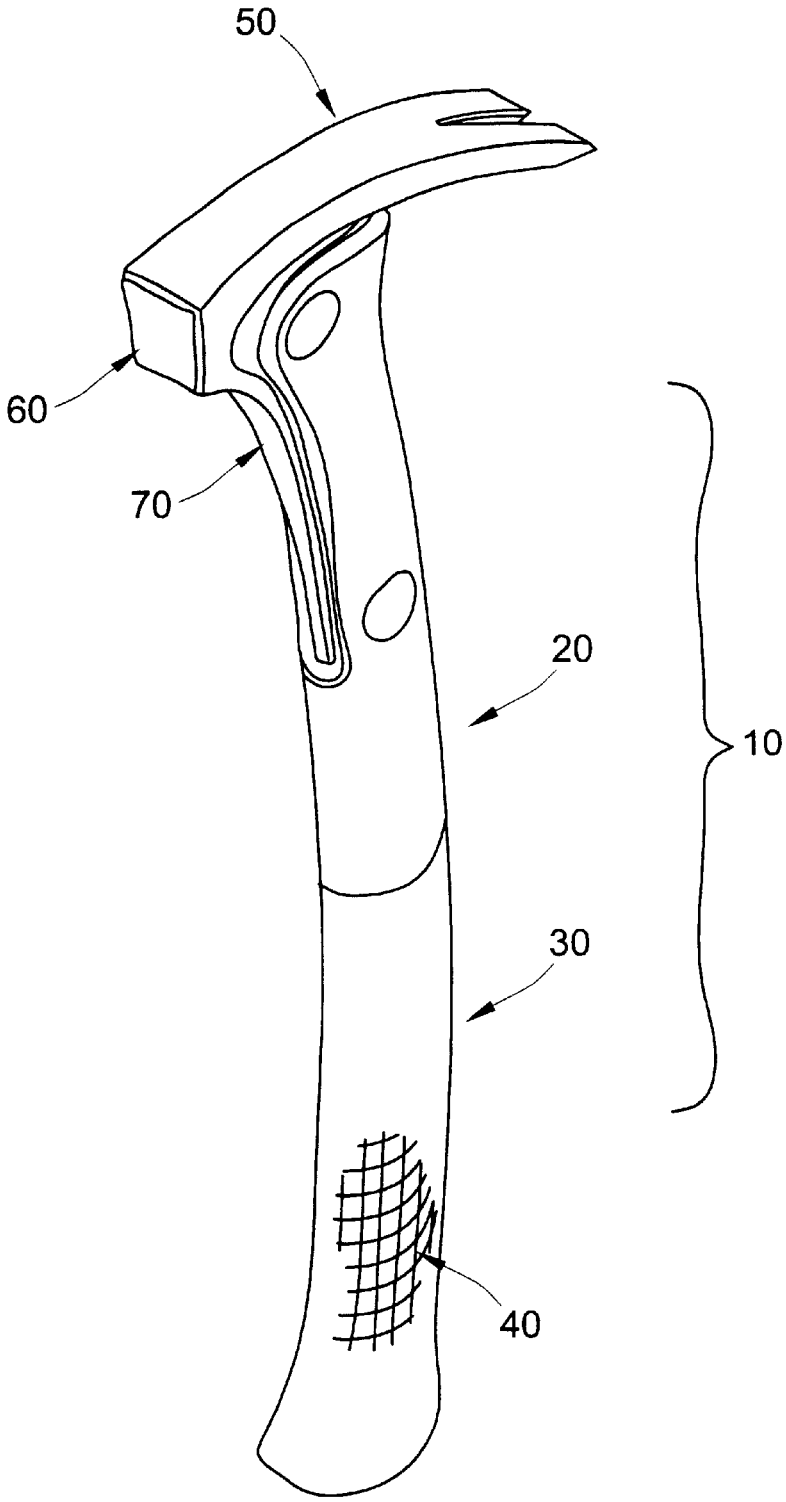
FIG. 6 illustrates a perspective view of a striking tool of one embodiment of the present invention.

In another embodiment, as shown in perspective view in FIG. 6, the present invention provides a striking tool 10. Striking tool 10 of the present invention includes a handle 30, a grip 40, an curved shank 20, and a head 50. The head 50 is adapted to be fixedly attached to the curved shank 20. Head 50 includes an overstrike flange 70, such that the effects of overstrike can be managed. Curved shank 20 is adapted to be attached to the handle 30. The handle 30 may be manufactured of a single material such that the handle 30 and the grip 40 are one and the same. Alternatively, the handle 30 may be manufactured such that the grip 40 is of a different material from that used to manufacture the remainder of the handle 30, where the grip 40 is adapted to encase the handle 30. The grip 40 may be further adapted to attach to the handle 30. As will be recognized by one of ordinary skill in the art, the handle 30 and the curved shank 20 may be manufactured as a unitary piece. However, the handle 30 may be separately manufactured from the curved shank 20 and the handle 30 and the curved shank 20 adapted to be attached, one to the other.

Figure 7:
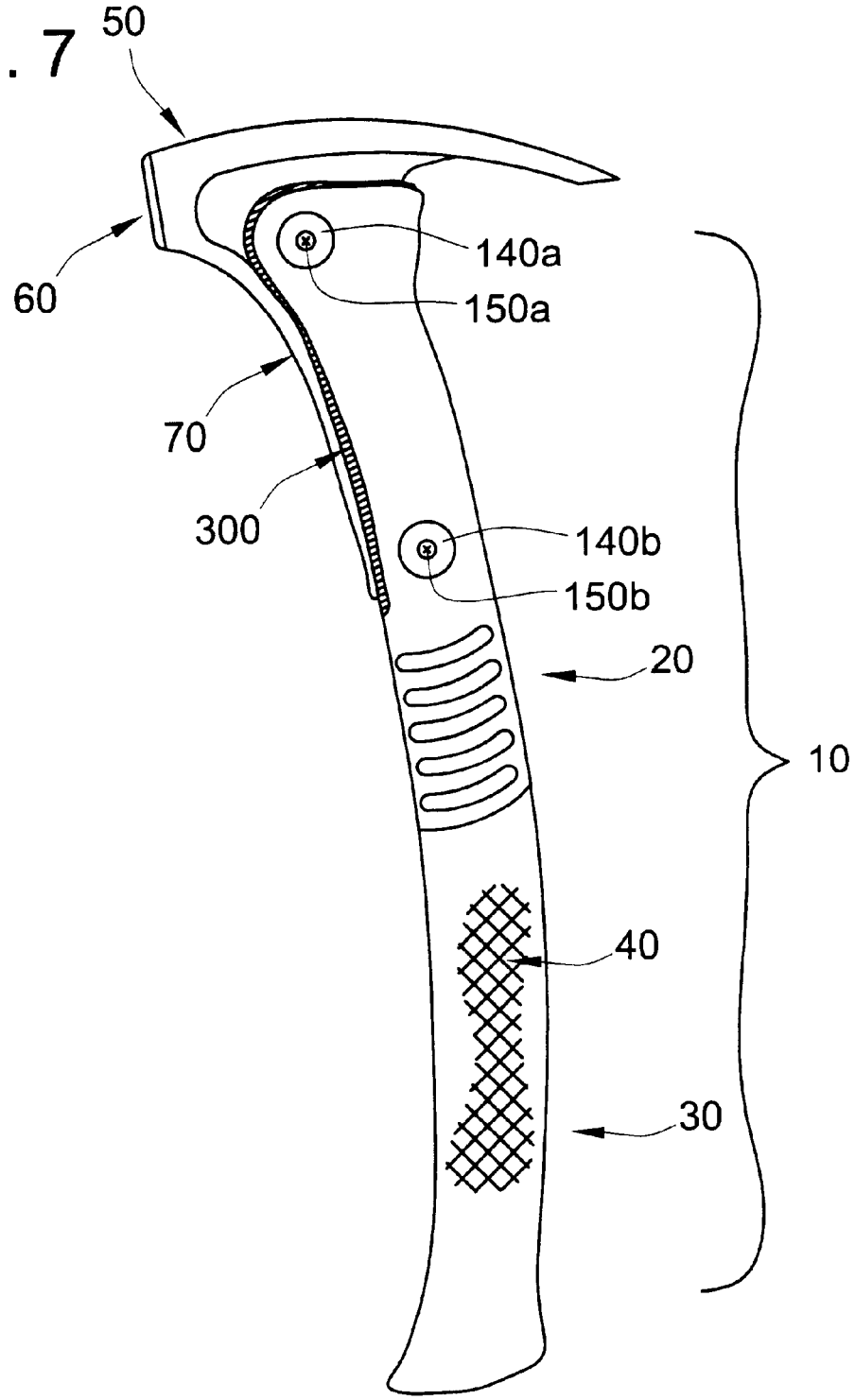
FIG. 7 illustrates a plan view of a striking tool of one embodiment of the present invention.

Another embodiment of a striking tool 10 is shown in FIG. 7. A head 50 is adapted to be fixedly attached to a curved shank 20. Head 50 can be fixedly attached to the curved shank 20 through fasteners 140 (a,b). Fasteners may include bolts, screws, pins, and the like, and may include various fastener head configurations. Each fastener 140 (a,b) may be attached to the curved shank 2 through an elastomer bushing or grommet 150 (a,b). The fasteners 140 (a,b) may be encircled by and can be properly seated in the resilient bushing 150 (a,b). Elastomer bushings 150 (a,b) may allow some forward and backward motion of head 50 during impact. A gasket 300 is molded into a groove surface (not shown) between head 50 and the curved shank 20. The gasket 300 may be manufactured from various elastomeric or other resilient materials. In one embodiment the gasket 300 can be injection molded into the curved shank 20. Head 50 includes an overstrike flange 70, such that the effects of overstrike can be managed. Curved shank portion 20 is adapted to be attached to a handle 30. The handle 30 may be manufactured of a single material such that the handle 30 and a grip 40 are one in the same. Alternatively, the handle 30 may be manufactured such that the grip 40 is of a different material from that used to manufacture the remainder of the handle 30, where the grip 40 is adapted to encase the handle 30. The grip 40 may be further adapted to attach to the handle 30. As will be recognized by one of ordinary skill in the art, the handle 30 and the curved shank 20 may manufactured as a unitary piece. However, the handle 30 may be separately manufactured from the curved shank 20 and the handle 30 and the curved shank 20 adapted to be attached, one to the other.

Figure 8:
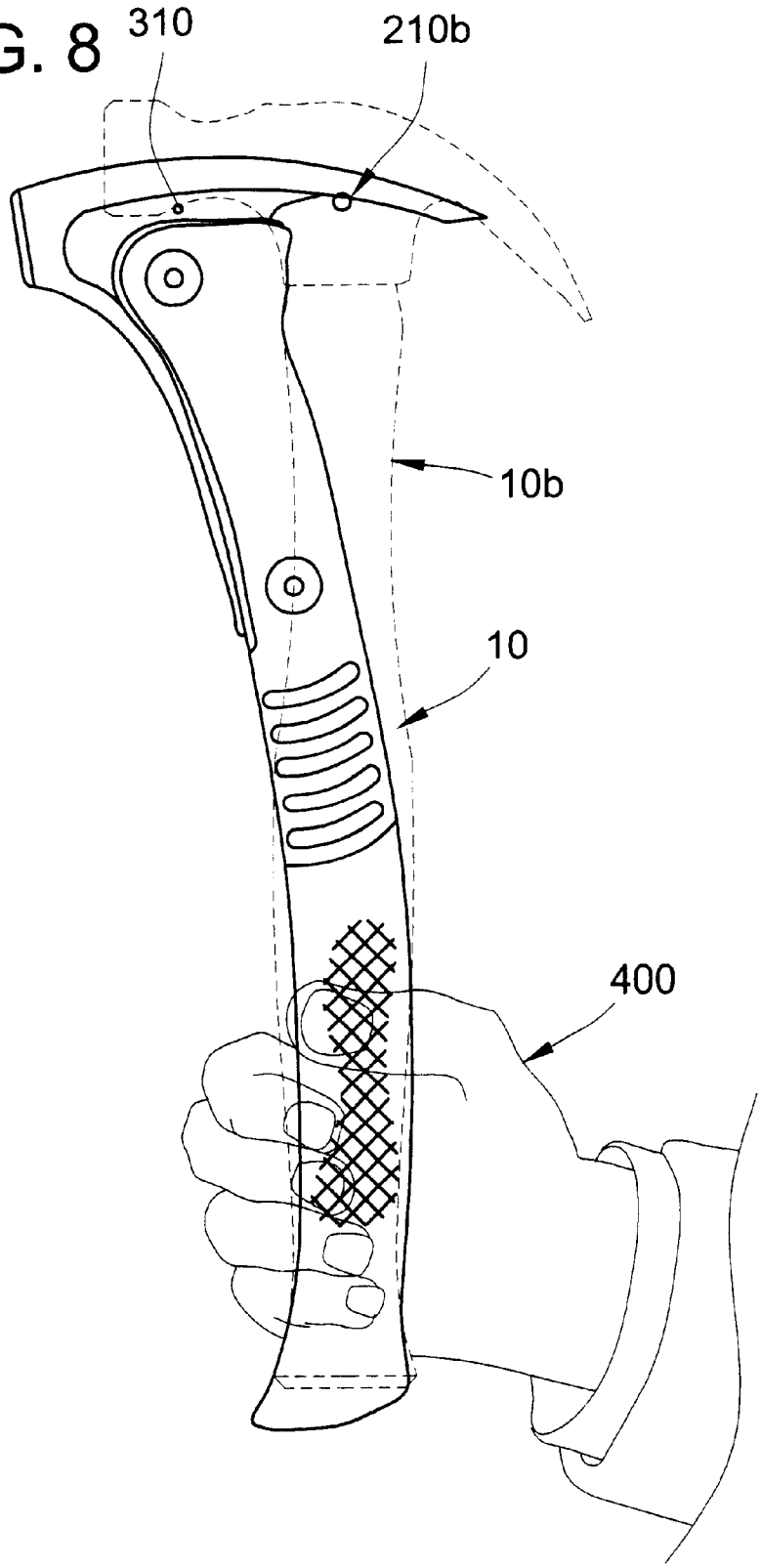
FIG. 8 illustrates a striking tool of one embodiment of the present invention being held by a human hand superimposed with a striking tool of the prior art.

FIG. 8 depicts the striking tool 10 of the present invention and the striking tool 10*b* of the prior art superimposed in a human gripping hand 400. The weight forward advantage is clearly shown in the curved structure of striking tool 10. In addition, the weight center 310 of the striking tool 10 of the present invention is clearly forward of the weight center 210*b* of the striking tool 10*b* of the prior art.

Figure 9:
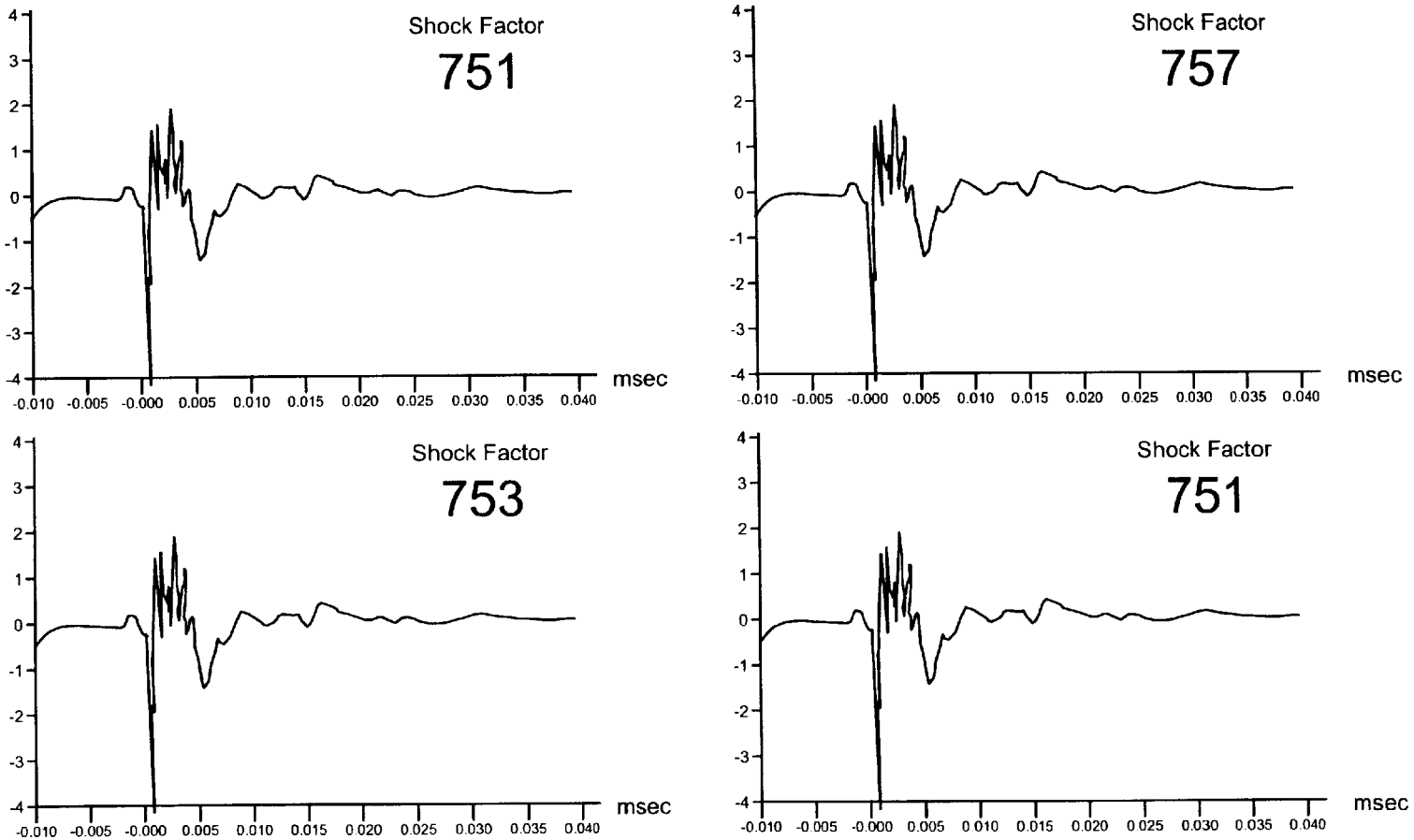
FIG. 9 illustrates Shock Factor data for the striking tool of FIG. 7.
Figure 10:
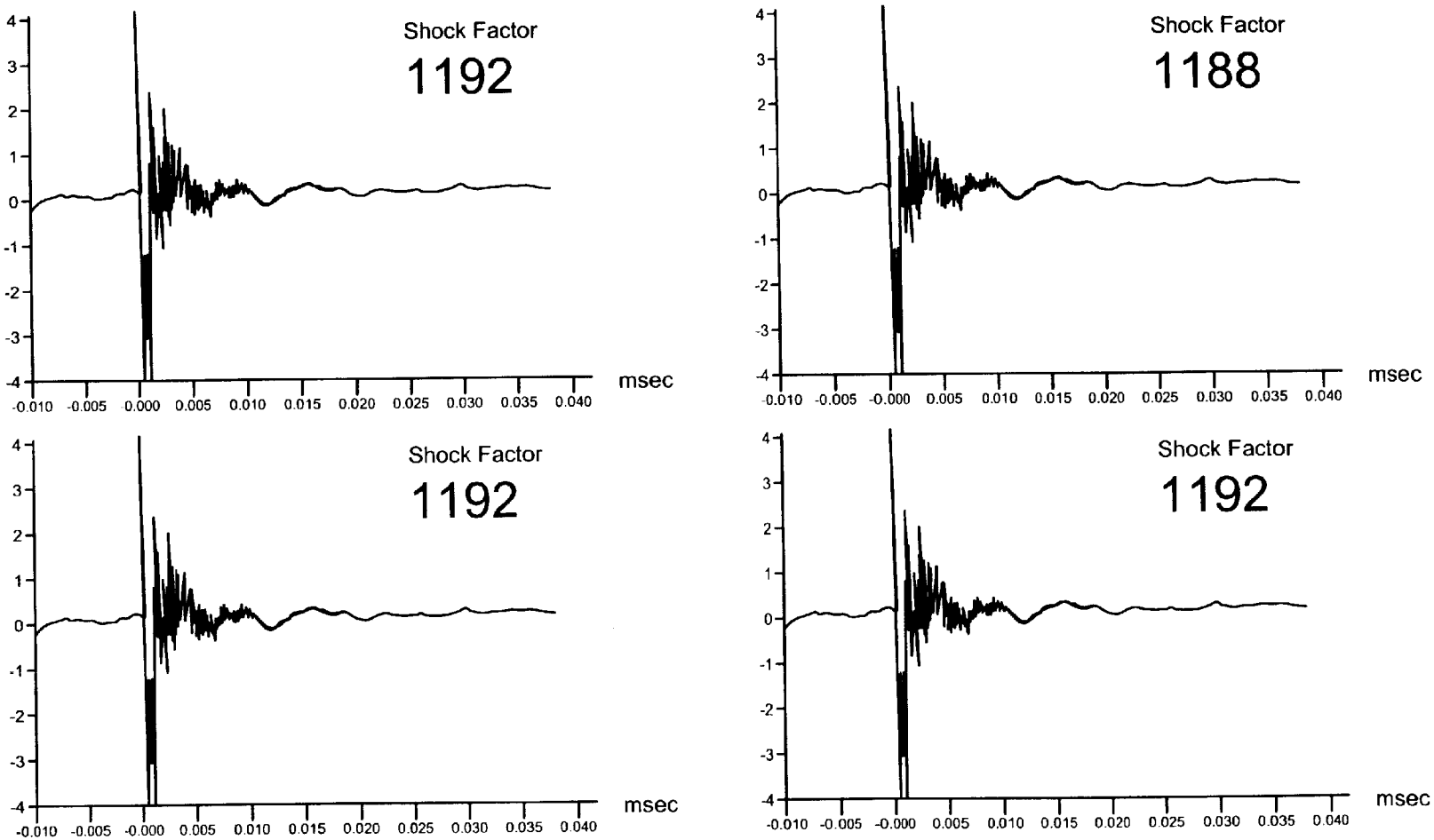
FIG. 10 illustrates Shock Factor data for a striking tool of the prior art.

FIGS. 9 and 10 illustrate Shock Factor data for a hand-held striking tool of one embodiment of the present invention and for a hand-held striking tool of the prior art, respectively. The hammers were subjected to shock and vibration testing. Each hammer tested was clamped into a polyurethane fixture. A sensor was wrapped around the hammer grip. The sensor consists of a length of 24 gage piezo-electric wire, adhered to a piece of vibration dampening material. The vibration dampening material served to isolate the grip from the fixture. The fixture was clamped onto a swing arm. During testing, the swing arm and fixture are raised to a pre-determined stop and then released. The face or head of the hammer being tested then strikes a steel anvil. The piezo-electric wire deforms due to the vibrations caused by the impact and generates an electric current proportional to the deformations and, correspondingly, the vibrations. The resulting current is recorded and provides a comparison of the vibration dampening capability of the various grip materials. A plot of current output as a function of time produces a vibration curve. From each vibration curve a Shock Factor is determined. The greater the vibration of a hammer during the test the greater the Shock Factor generated for that hammer. The Shock Factor data illustrates shock magnitude, in relative units, on the y-axis and shock duration, in milliseconds (msec), on the x-axis. The longer a striking tool being tested vibrates after being struck, the greater the magnitude of shock magnitude and shock duration. The Shock Factor is calculated from this data and a larger Shock Factor represents a greater magnitude of shock magnitude and shock duration. The data of FIG. 9 was collected from tests performed on a hand-held striking tool configured as depicted in FIG. 7. The data of FIG. 10 was collected from tests-performed on a prior art hammer. The data of FIG. 9 demonstrates that a hand-held striking tool of one embodiment of the present invention has an average Shock Factor of 753, whereas the data of FIG. 10, for the hammer of the prior art, demonstrates an average Shock Factor of 1191. Surprisingly and unexpectedly a hammer of the present invention has 63 percent of the Shock Factor of a hammer of the prior art, a reduction of 37 percent. A comparison of the data of FIGS. 9 and 10 illustrates that there is significant dampening of vibrations in the striking tool of the present invention shortly after it is struck as compared to the hammer of the prior art.

Figure 11:
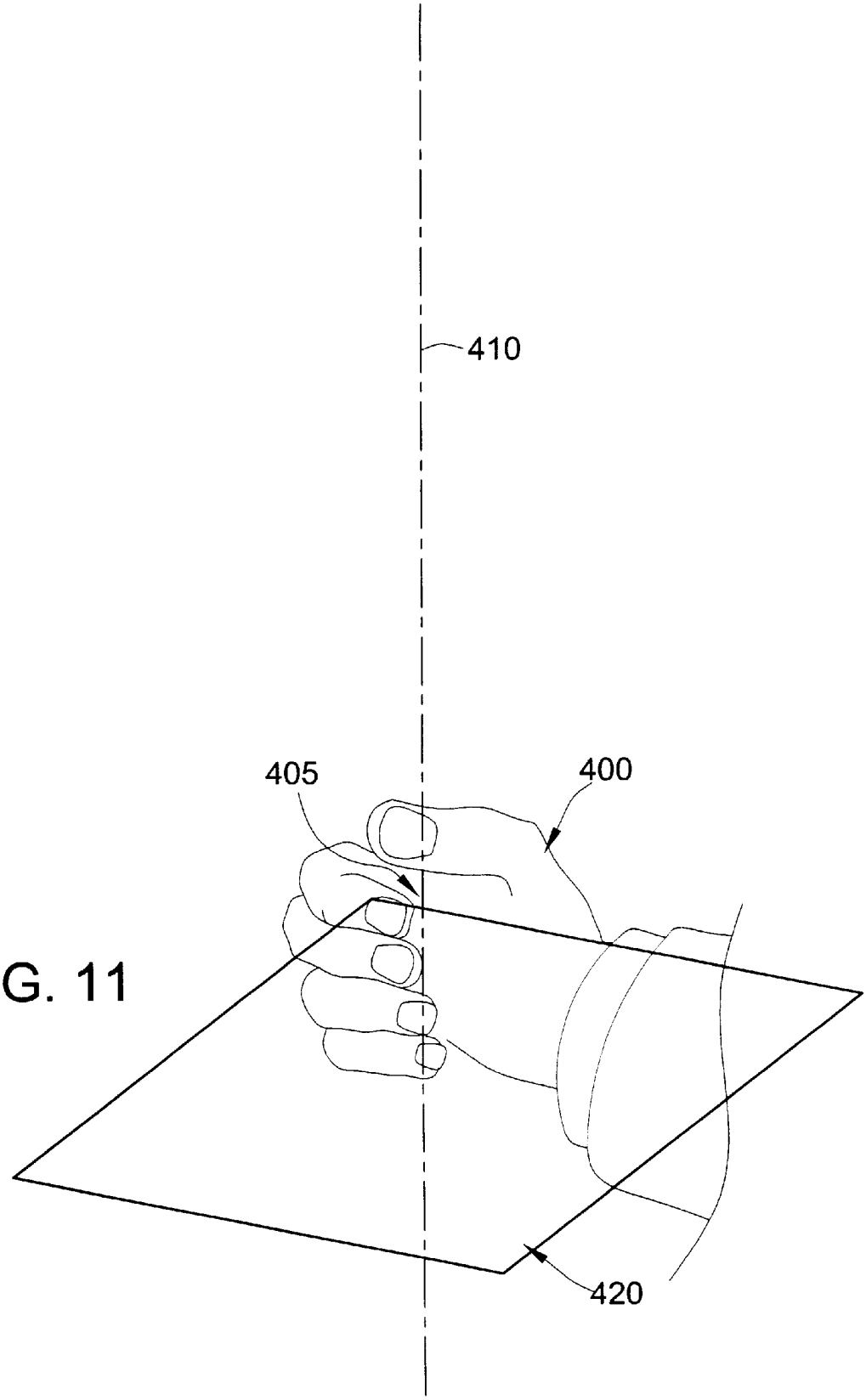
FIG. 11 illustrates a human hand adapted to grip an object, the center of the hand defining a vertical line that is perpendicular to a horizontal plane.

FIG. 11 depicts a human hand adapted to grip an object, defines a gripping hand 400. The gripping hand 400 is further defined such that a vertical line 410 disposed in the center 405 of the gripping hand 400 is perpendicular to a horizontal plane 420. The position of the gripping hand with respect to the vertical line 410 and the horizontal plane 420 is referred to as the normal gripping position.

Figure 12:
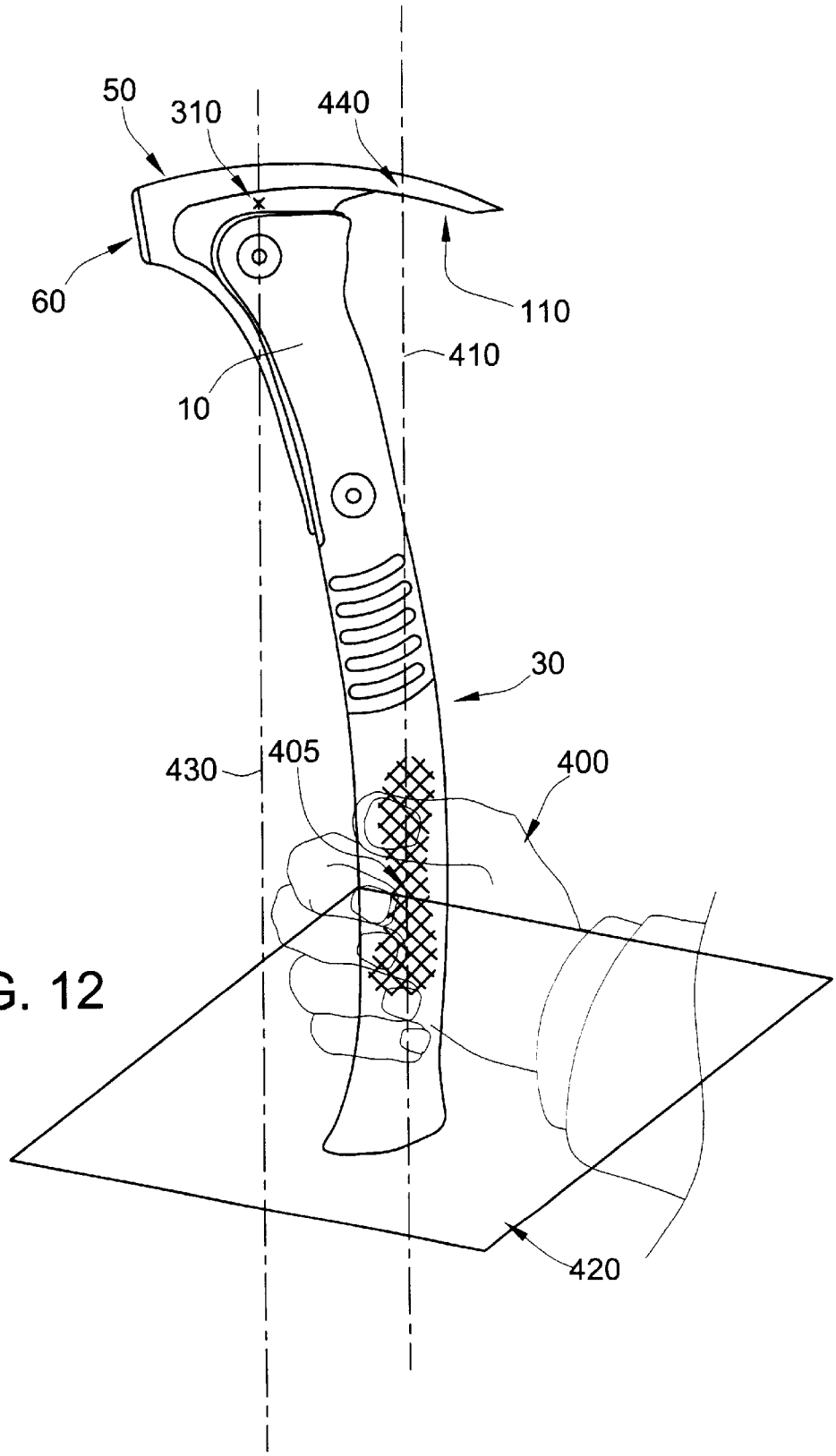
FIG. 12 illustrates a striking tool of one embodiment of the present invention held in the gripping hand of FIG. 11.

FIG. 12 depicts a striking tool 10 which defines a weight center 310. When striking tool 10 is held in the normal gripping position by the gripping hand 400 the vertical line 410 intersects the head 50 of the striking tool 10 at a point 440, which is approximately at the notch of the V of a claw 110. The handle 30 and the head 50 define the vertical line 410 such that the vertical line intersects the head at the point 440, which is approximately at the notch of the V of the claw 110, and which is distal from the striking surface 60 and where the weight center 310 is proximal to the striking surface 60. The relative horizontal separation of point 440 and weight center 310 is clearly demonstrated by a parallel line 430 to vertical line 410 which intersects weight center 310.

Figure 13:
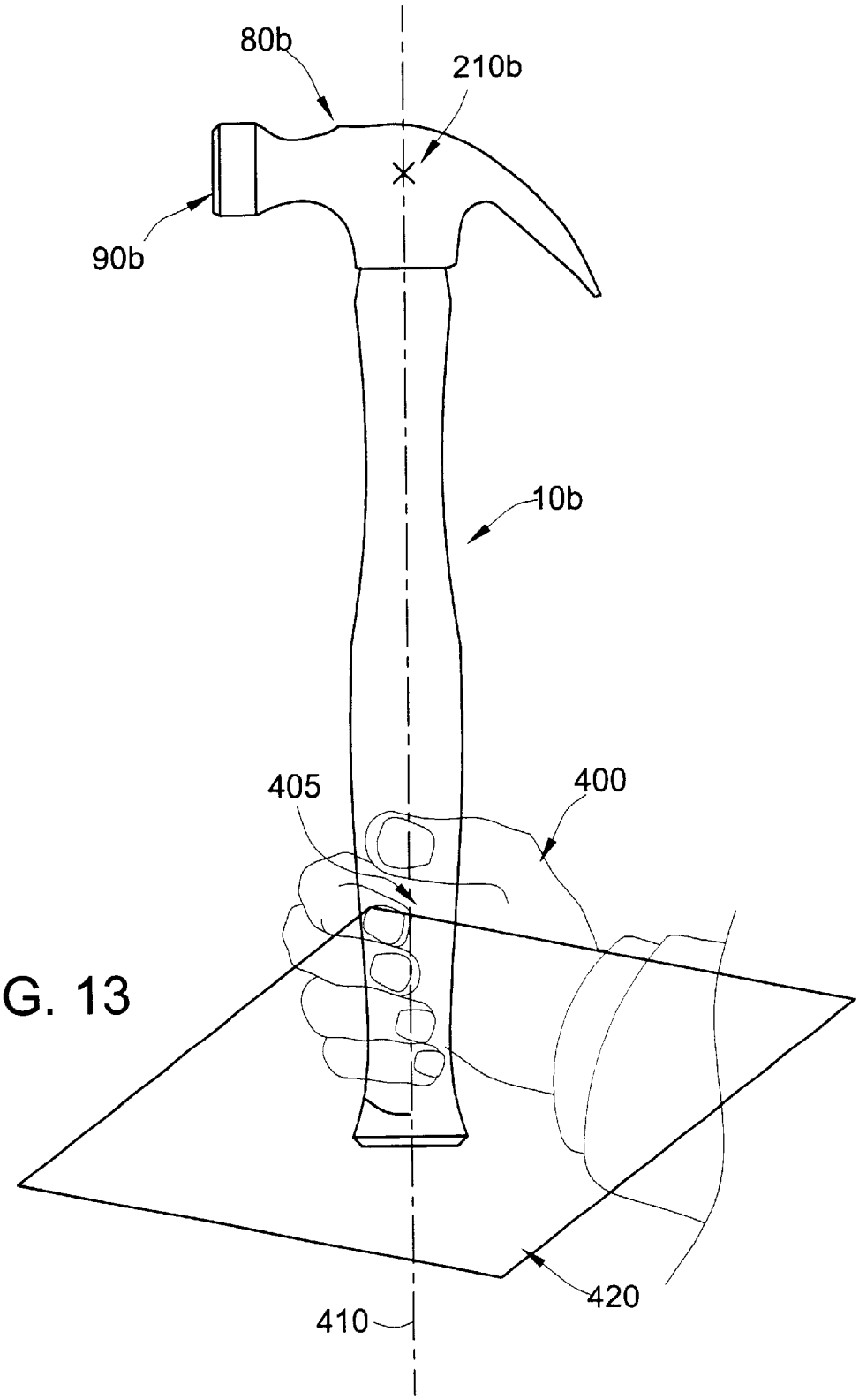
FIG. 13 illustrates a striking tool of the prior art held in the gripping hand of FIG. 11.

FIG. 13 depicts a striking tool 10*b* of the prior art, which defines a weight center 210*b*. When striking tool 10*b* is held in the normal gripping position by the gripping hand 400 the vertical line 410 intersects the head 80*b* of the striking tool 10*b* at approximately the weight center 210*b*, that is approximately through the centerline. In contrast to FIG. 12, no parallel line is shown that is proximal to the striking face 90*b* in the striking tool 10*b* of the prior art.

Figure 14:
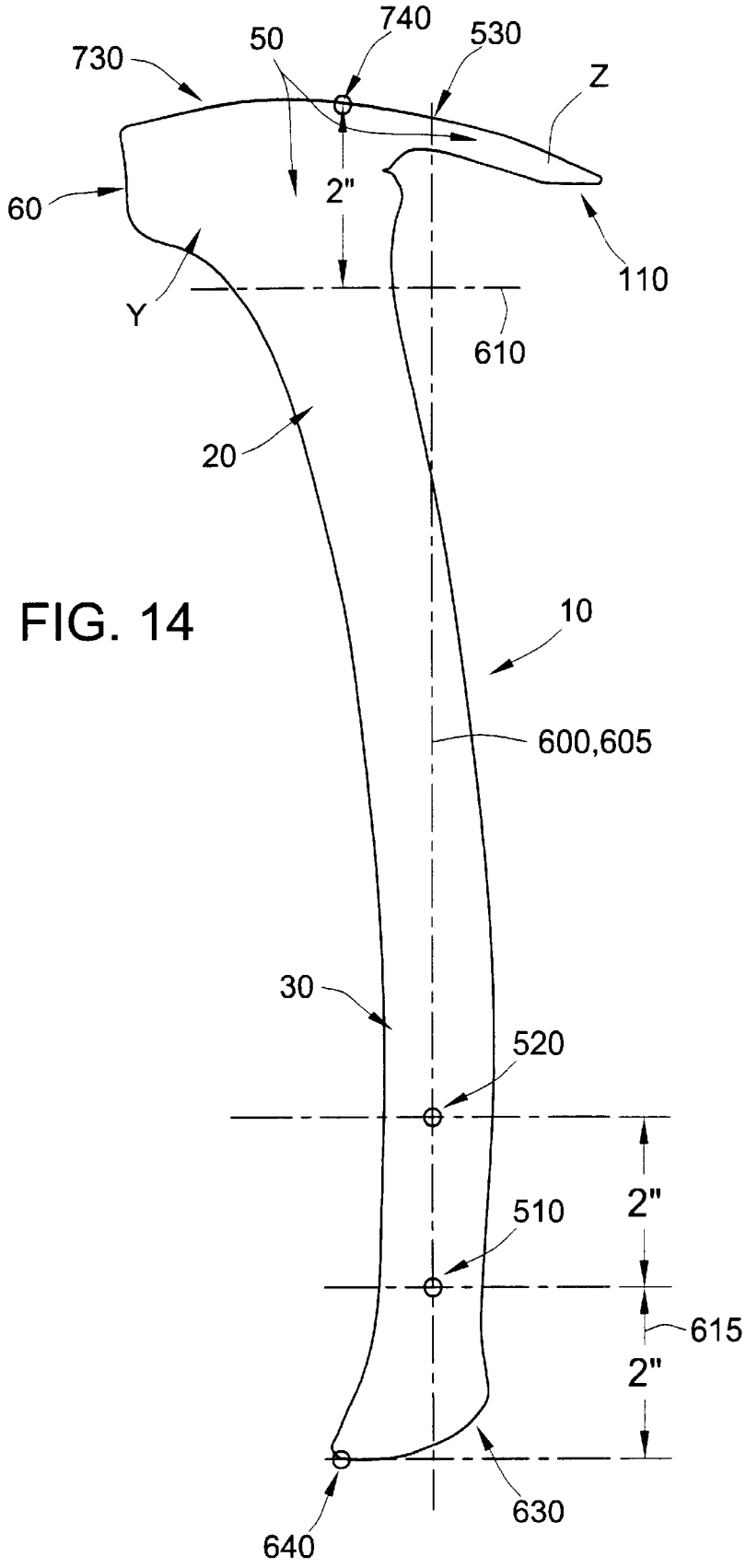
FIG. 14 illustrates an alternative embodiment of the present invention depicting the weight distribution of the striking tool head portion of the striking tool of the present invention.

The effect of the weight forward design of the present invention has been measured in comparison to the weight distribution of a striking tool head for several prior art devices. One embodiment of the striking tool 10 of the present invention (hereafter Embodiment A) is shown in FIG. 14. A horizontal plane (not shown) is defined as the plane on which the striking tool 10 rests when laid flat on its side, such as when laid on a tabletop. The bottom surface of a handle 30 defines a bottom edge 630. The bottom edge 630 defines a bottommost point 640 distal to a striking surface 60. A first point 510 is positioned along the longitudinal center line of the handle 30 proximal to the bottommost point 640 of the handle 30. A second point 520 is located along the longitudinal center line of the handle 30 and is 2 inches vertically up the handle 30 as measured from the first point 510. A straight line 600 connects the first point 510 and the second point 520 and is extended to intersect a top edge point 530 of a metallic head 50. The vertical distance between the first point 510 and the bottommost point 640 is 2 inches as measured along a line 615 that is parallel to the line 600, as shown in FIG. 14. A first cutting plane 605 intersects the line 600 and is perpendicular to the horizontal plane (not shown) of the striking tool 10.

The top surface of the metallic head 50 defines a top edge 730. The top edge 730 defines a center point 740. A second cutting plane 610 is defined perpendicular to the first cutting plane 605 and intersects a shank 20 of the striking tool 10 2 inches below the second center point 740 as shown in FIG. 14. The second cutting plane 610 is also perpendicular to the horizontal plane of the striking tool 10. The first cutting plane 605 and the second cutting plane 610, thus, define 2 regions of the metallic head 50. A first region Y is defined proximal to the striking surface 60, the first region Y being that portion of the metallic head 50 that includes the striking surface 60 and is cut from the metallic head 50 along the first and second cutting planes. A second region Z is defined distal to the striking surface 60 and is that portion of the metallic head 50 that includes a claw 110 as depicted in FIG. 14 and is cut from the metallic head 50 by the first and second cutting planes. The first region Y and the second region Z define a head portion Y+Z of the striking tool 10 extending 2 inches down as measured from the center point 740, whereupon the shank 20 begins.

Figure 15:
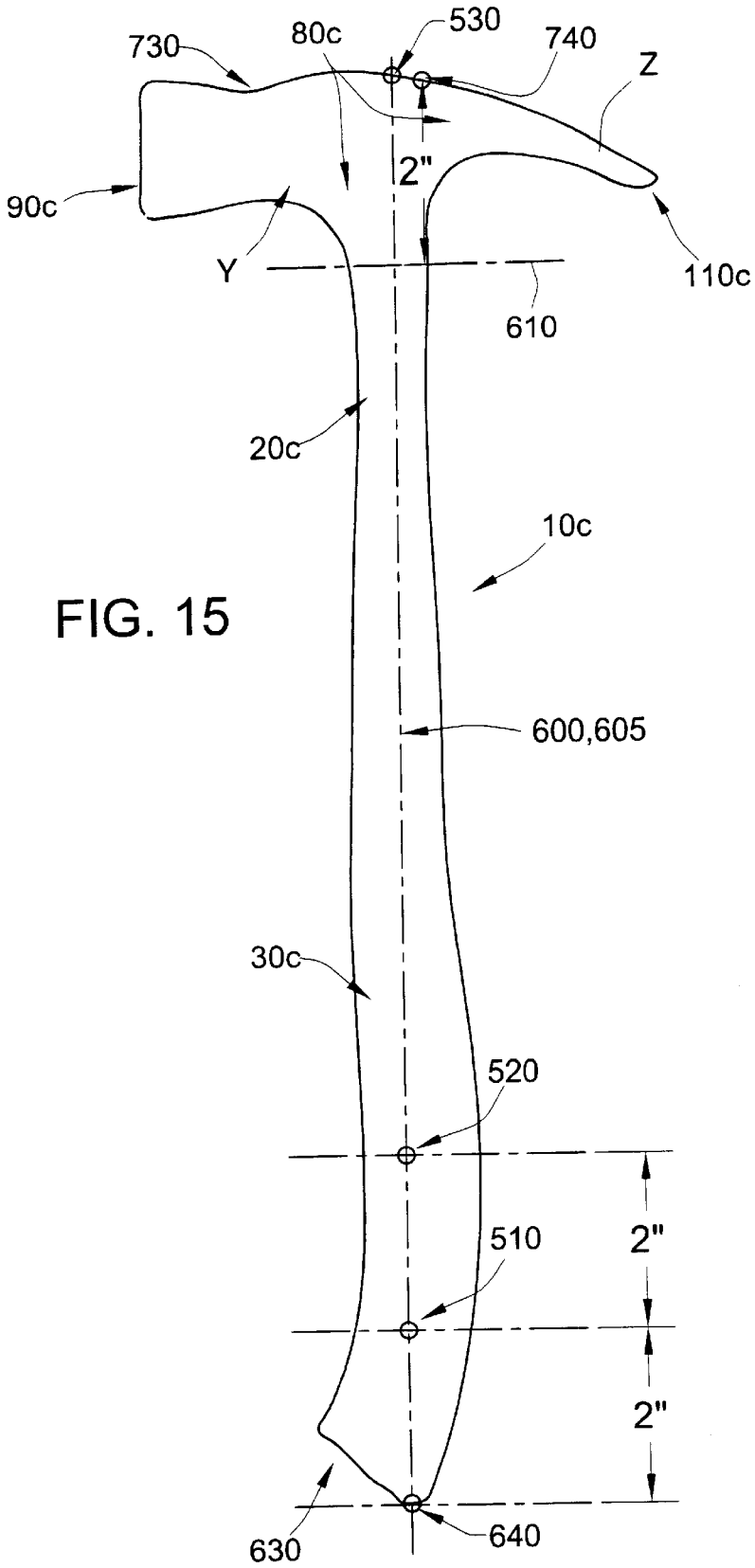
FIGS. 15–27 illustrate the weight distribution of the striking tool head portion of striking tools of the prior art.

FIG. 15 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 15. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 15. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 15 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 16:
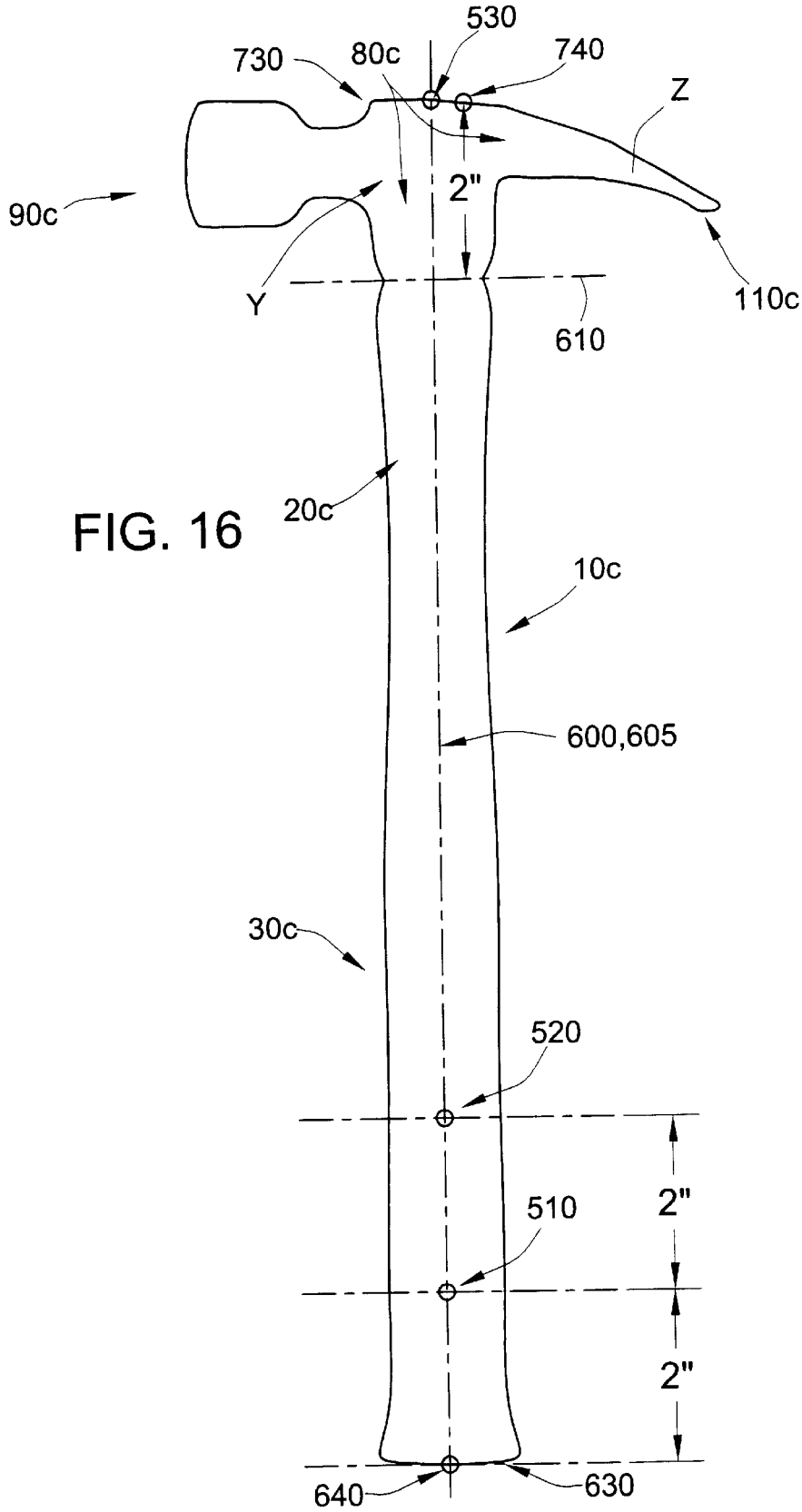

FIG. 16 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 16. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 16. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 16 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 17:
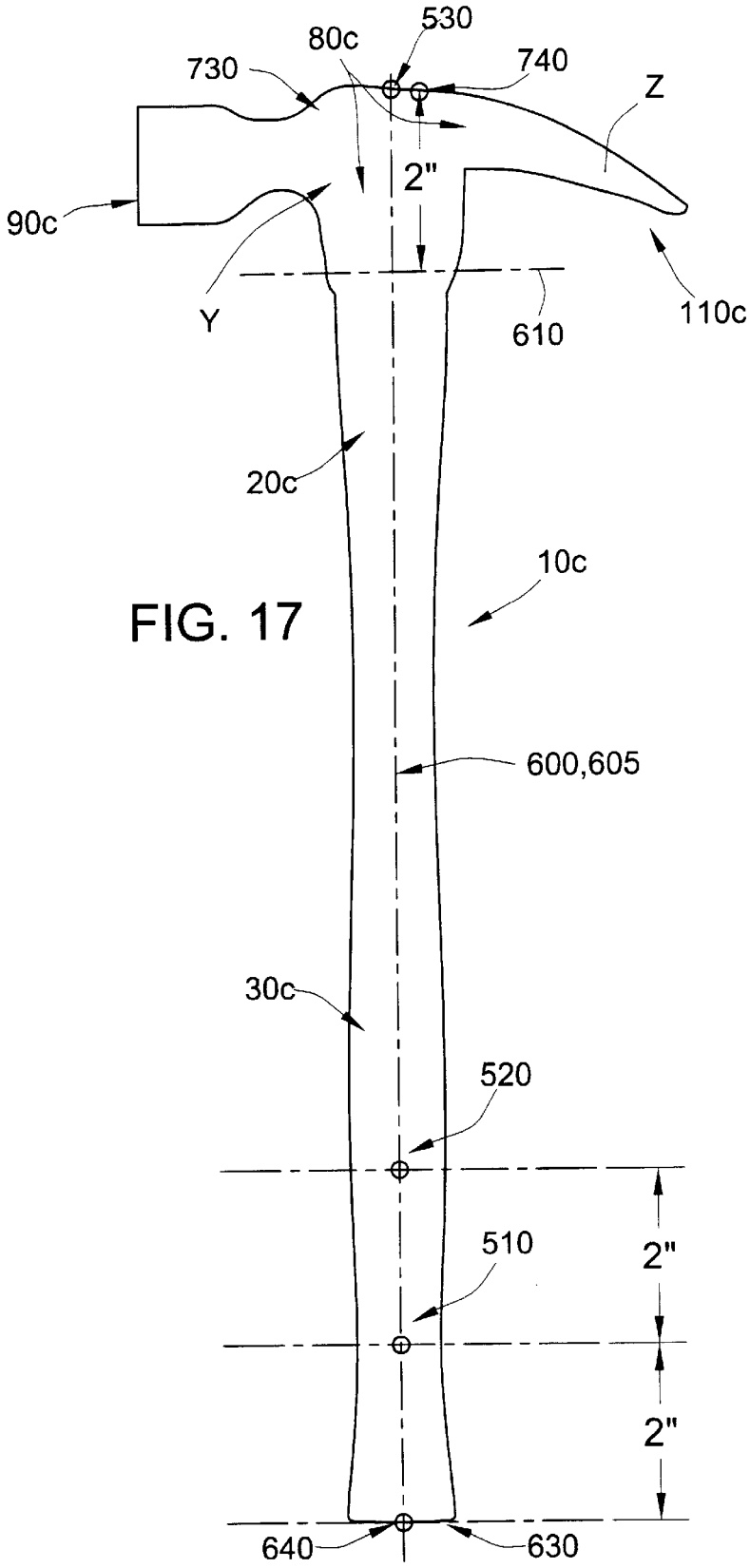

FIG. 17 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 17. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 17. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 17 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 18:
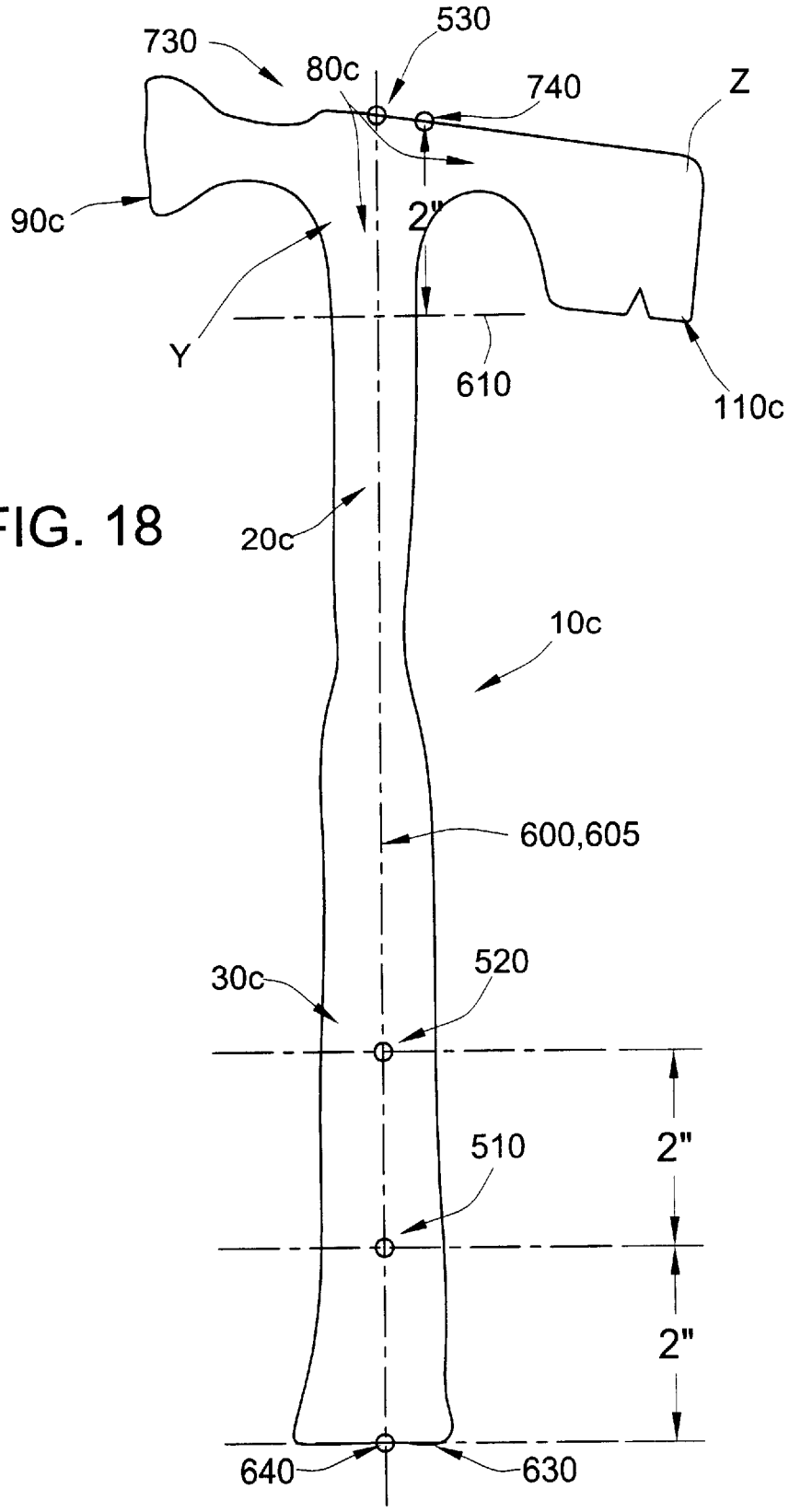

FIG. 18 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 18. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 18. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 18 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 19:
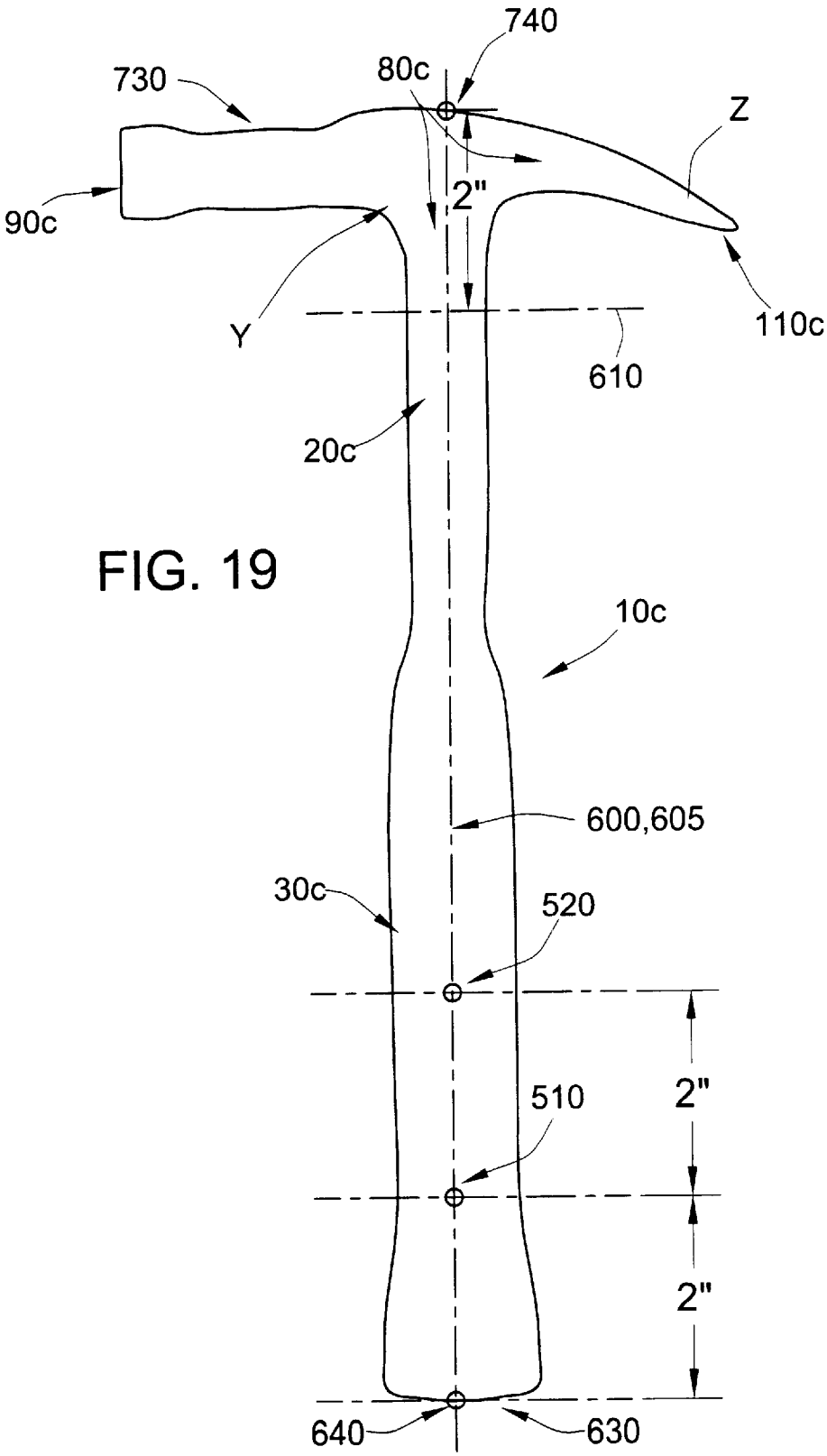

FIG. 19 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 19. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 19. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 19 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 20:
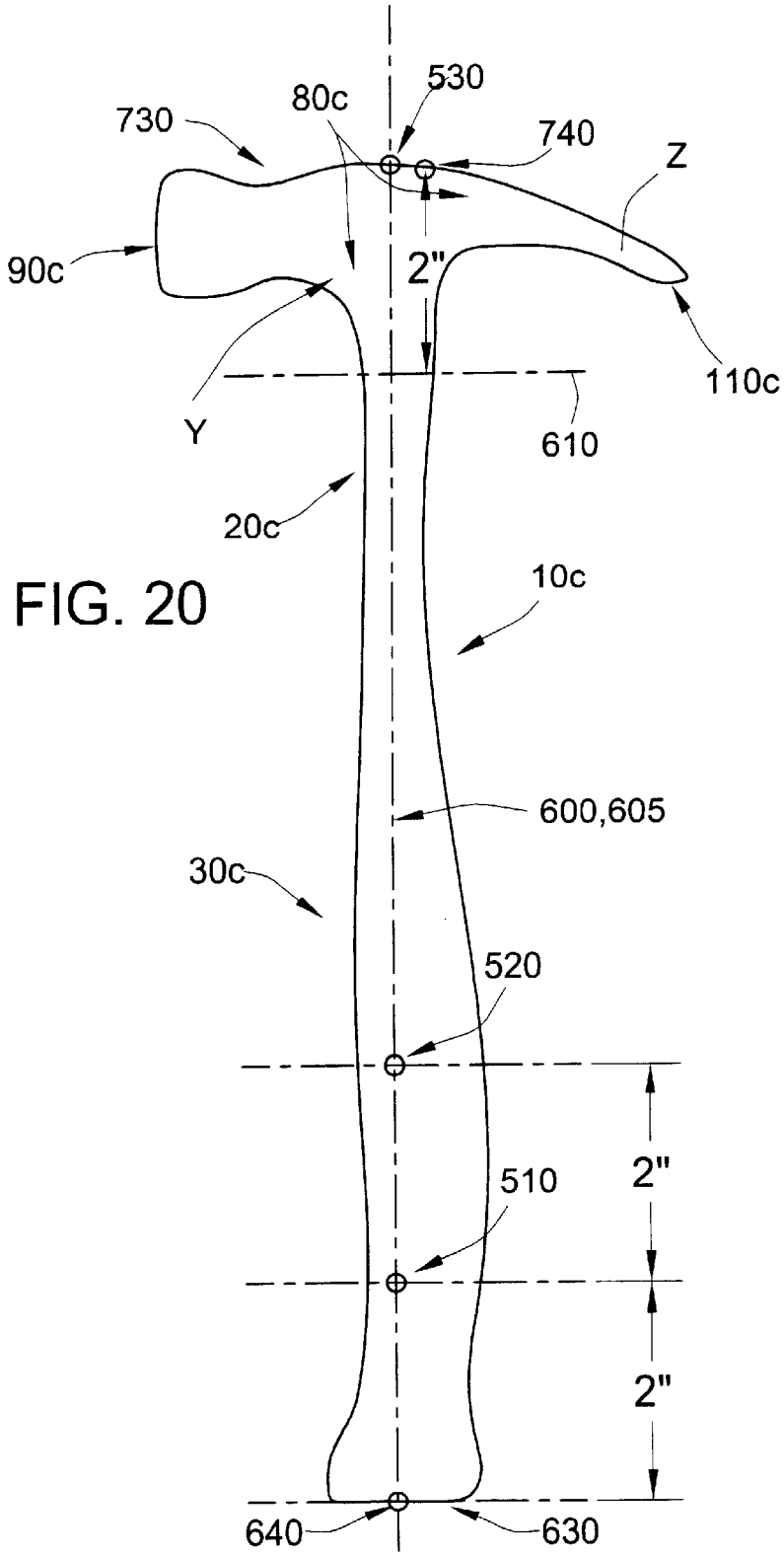

FIG. 20 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 20. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 20. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 20 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 21:
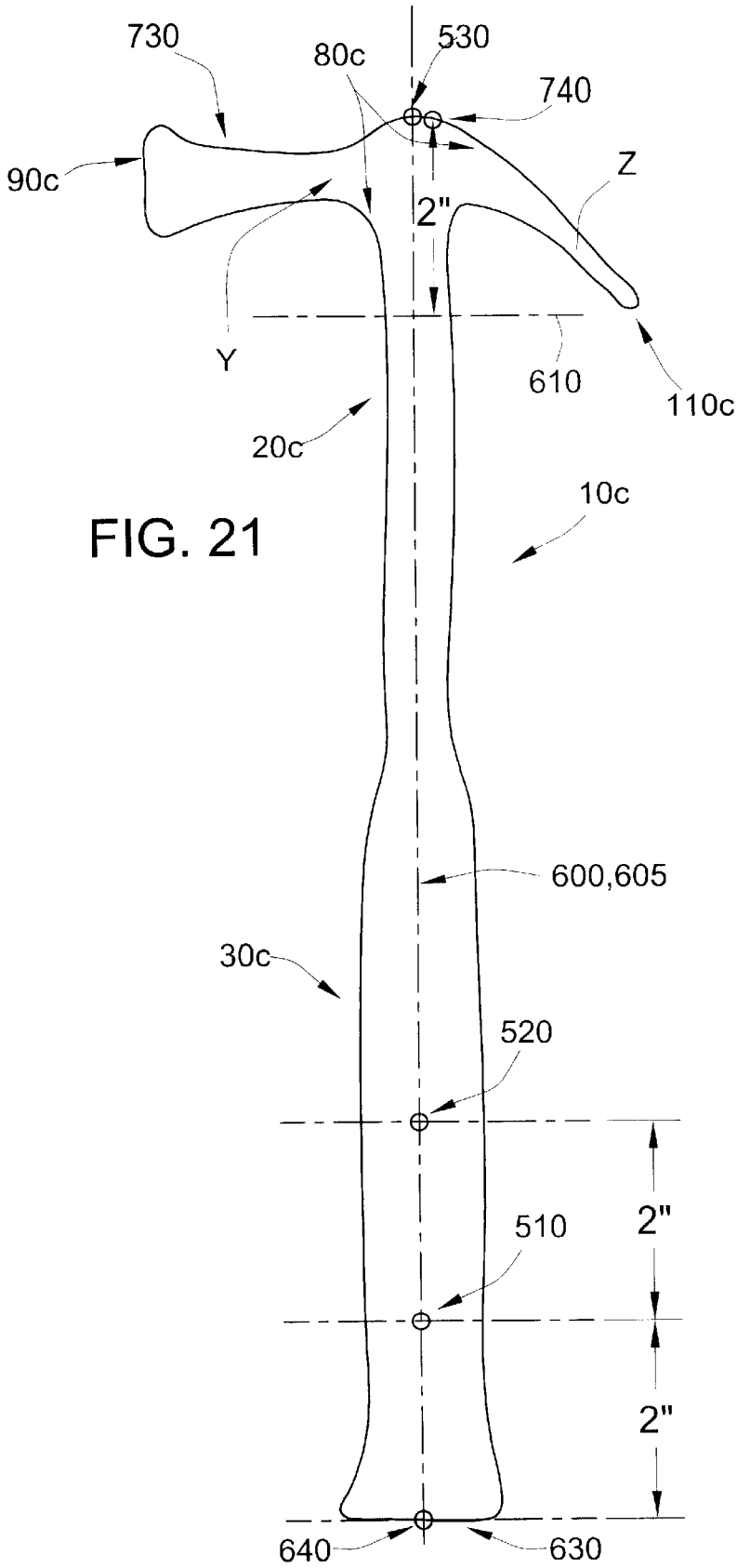

FIG. 21 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 21. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 21. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 21 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 22:
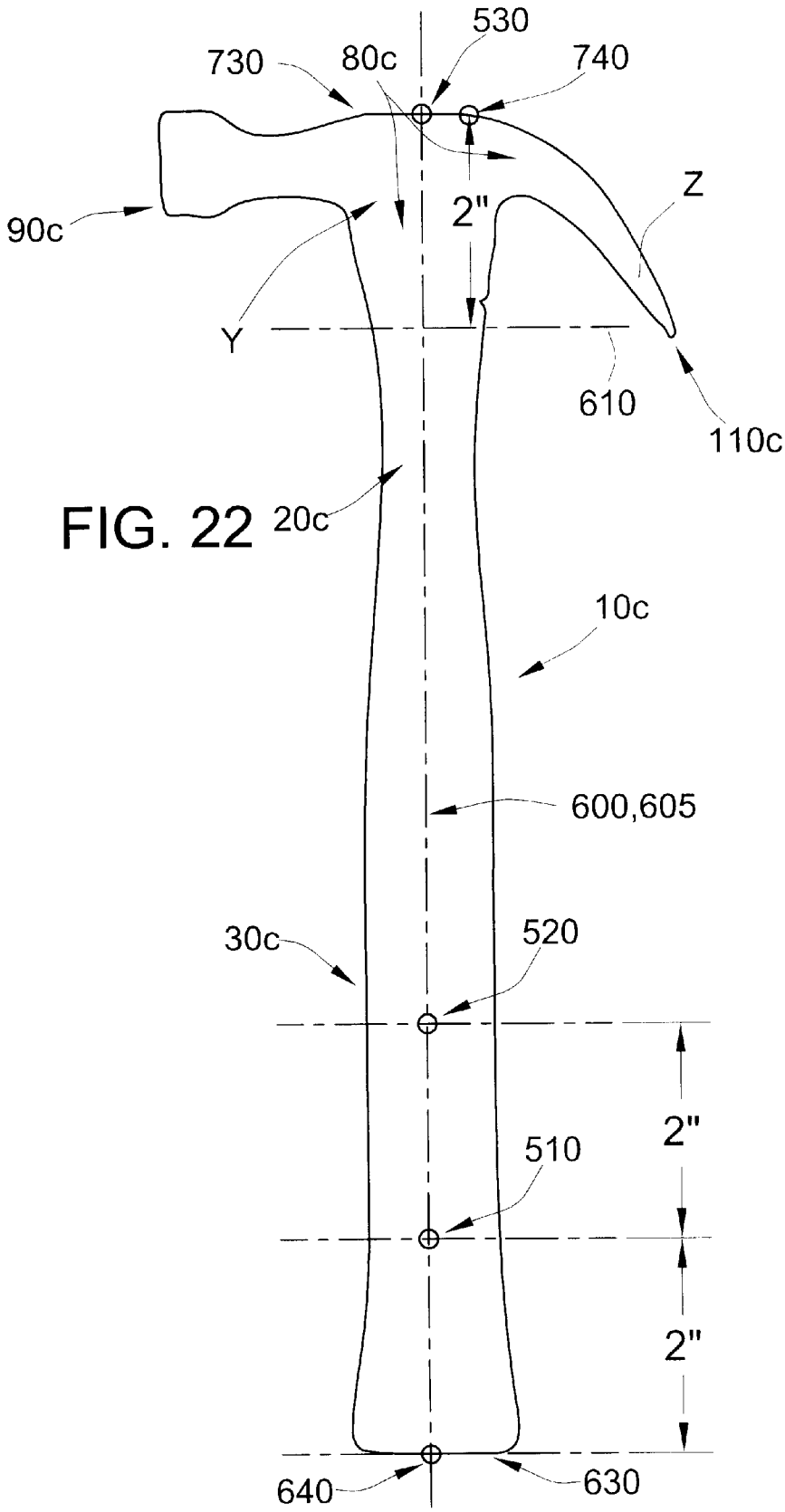

FIG. 22 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 22. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 22. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 22 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 23:
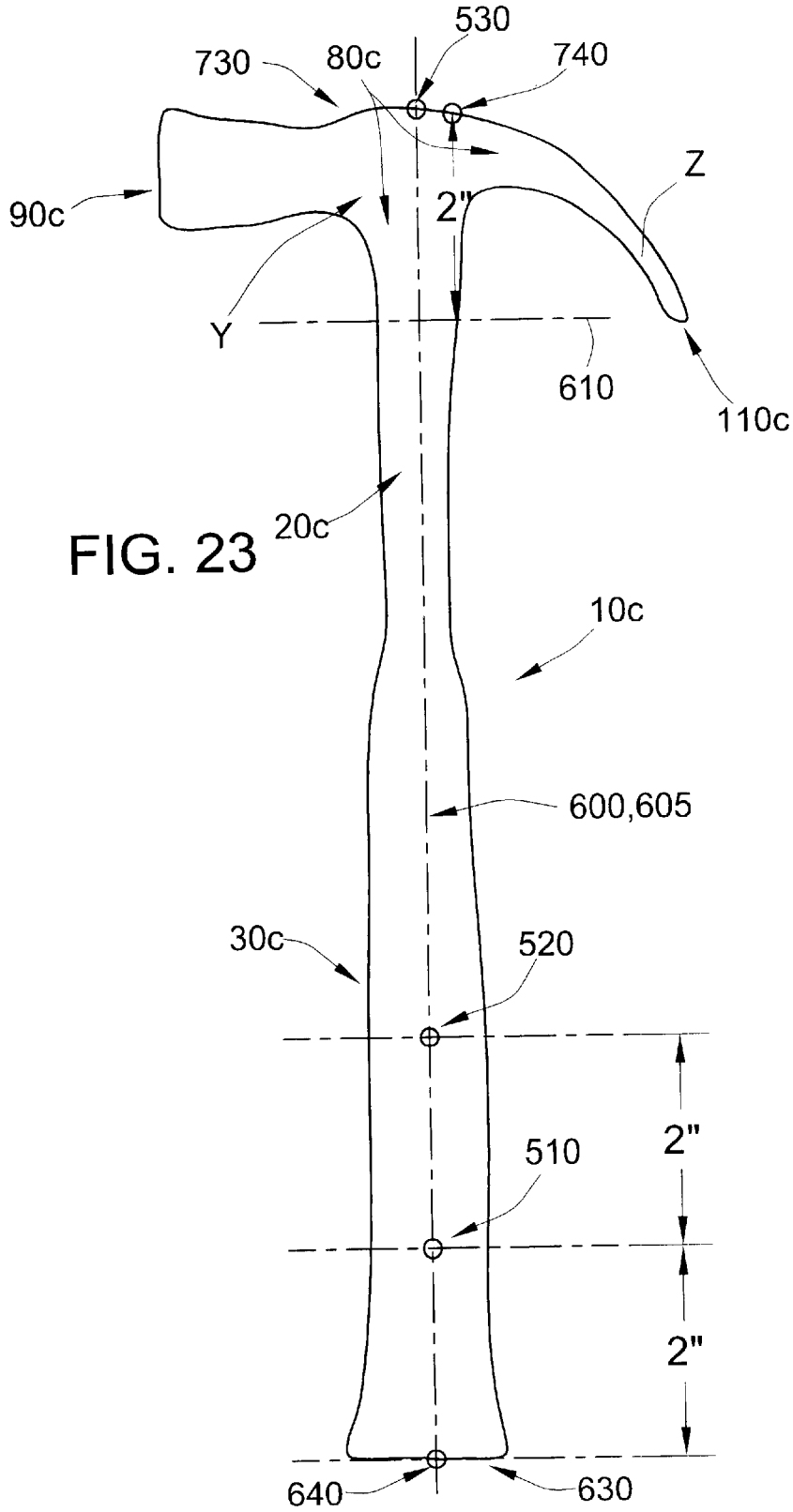

FIG. 23 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 23. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 23. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 23 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 24:
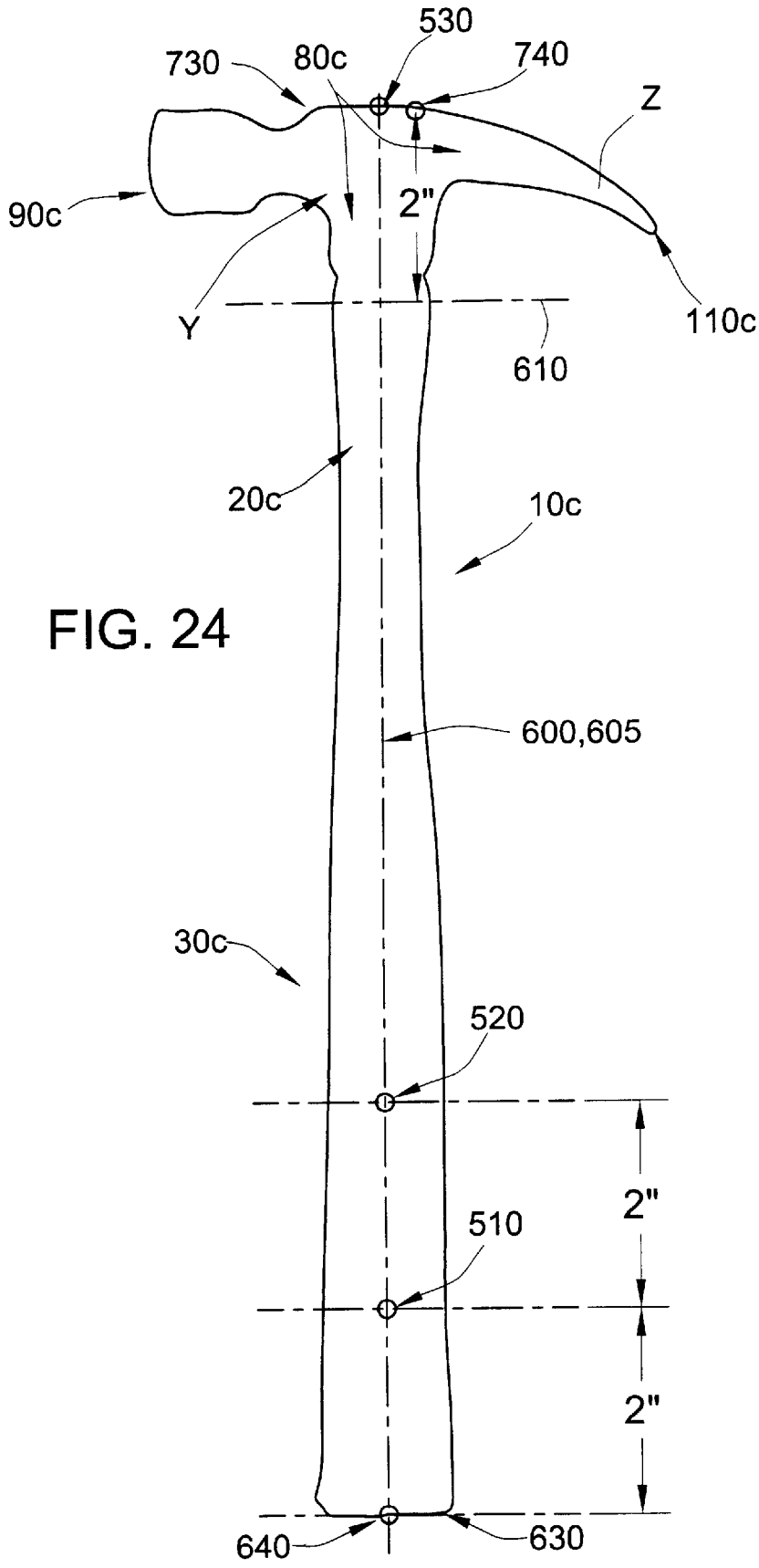

FIG. 24 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 24. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 24. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 24 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 25:
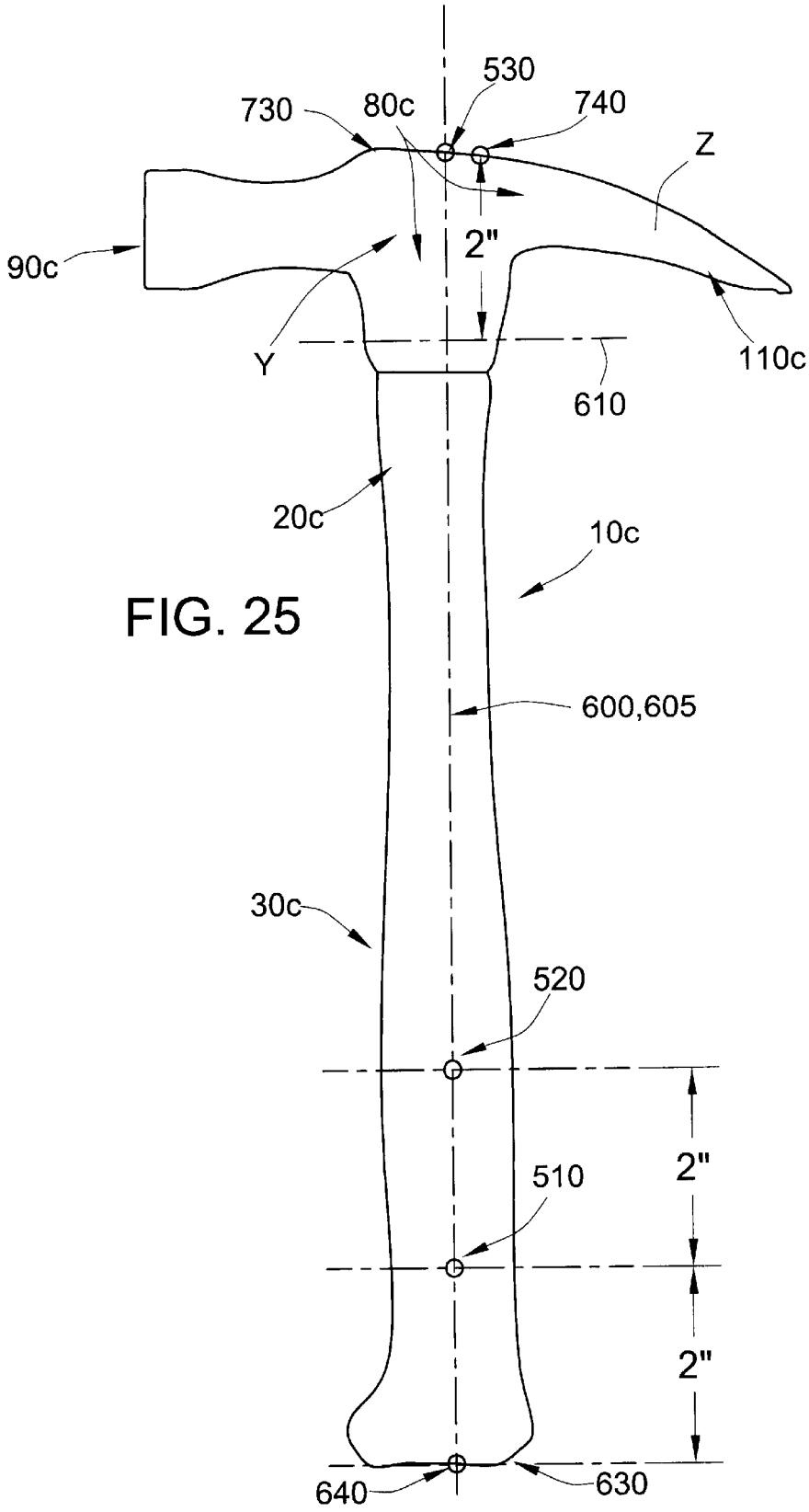

FIG. 25 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 25. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 25. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 25 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 26:
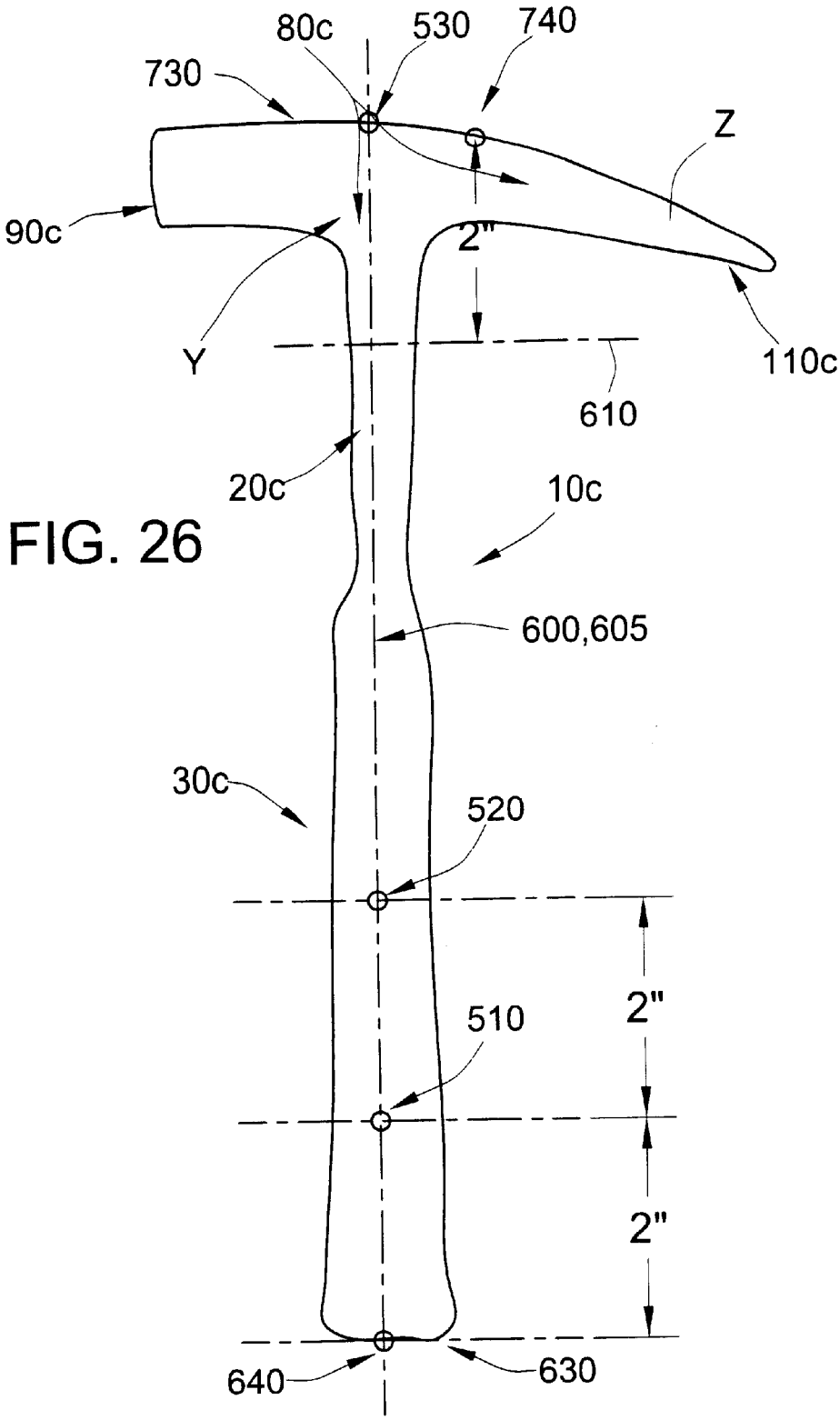

FIG. 26 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 26. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 26. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 26 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 27:
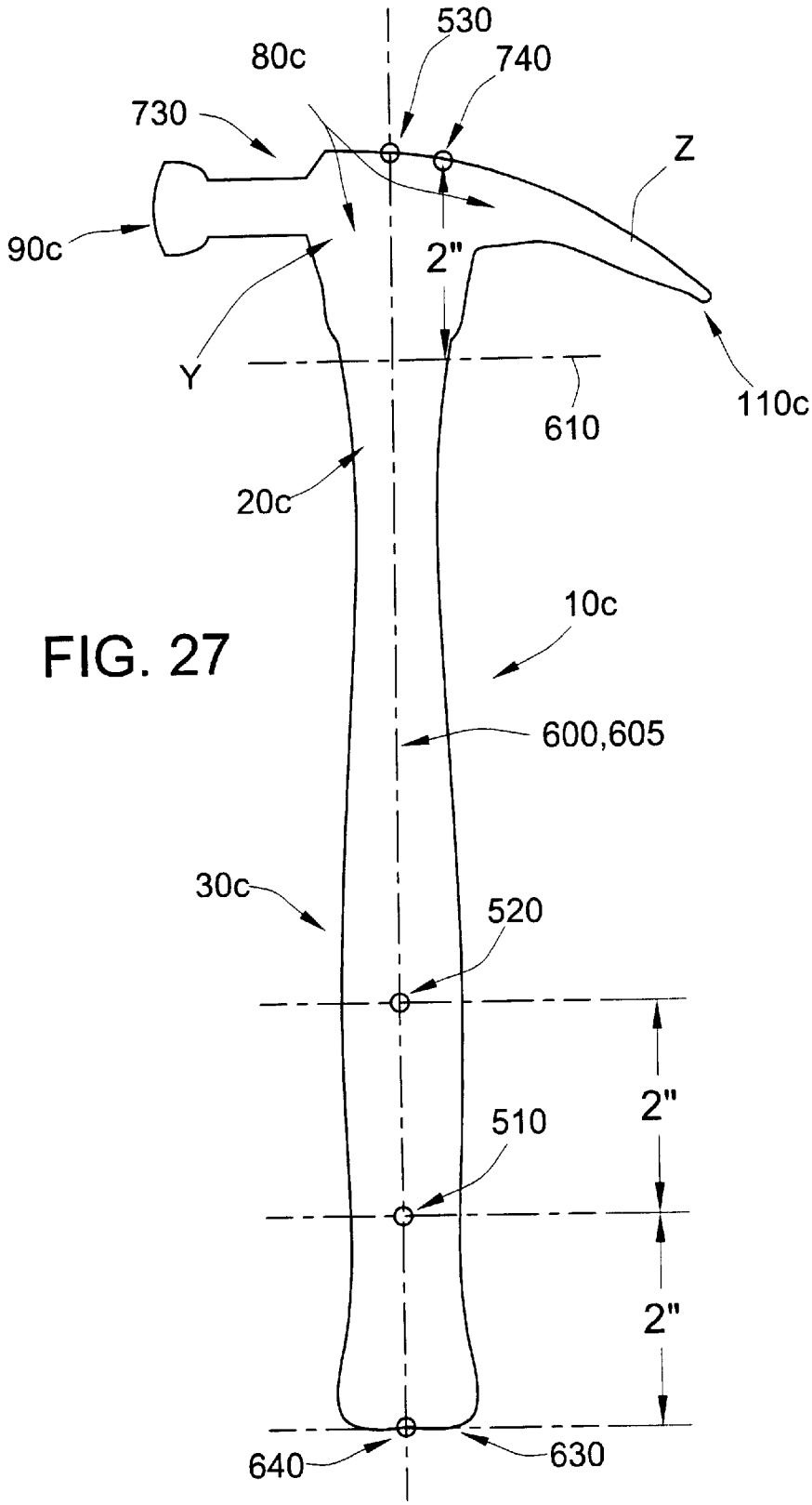

FIG. 27 depicts a striking tool 10*c* of the prior art. A horizontal plane (not shown) is defined as the plane on which the striking tool 10*c* rests when laid on its side, such as when laid on a tabletop. The bottom surface of a handle 30*c* defines a bottom edge 630. The bottom edge 630 defines a bottommost point 640 (which is at the center point of the edge) distal to a striking surface 90*c*. A first point 510 is positioned along the longitudinal center line of the handle 30*c* proximal to the bottommost point 640 of the handle 30*c*. A second point 520 is located along the longitudinal center line of the handle 30*c* and is 2 inches vertically up the handle 30*c* as measured from the first point 510. A straight line 600 connects the first point 510 and the second point 520 and is extended to intersect a top edge point 530 of a metallic head 80*c*. The vertical distance between the first point 510 and the bottommost point 640 is 2 inches as measured along the line 600, as shown in FIG. 27. A first cutting plane 605 intersects the line 600 and is perpendicular to the horizontal plane (not shown) of the striking tool 10*c*.

The top surface of the metallic head 80*c* defines a top edge 730. The top edge 730 defines a center point 740. A second cutting plane 610 is defined perpendicular to the first cutting plane 605 and intersects a shank 20*c* of the striking tool 10*c* 2 inches below the second center point 740 as shown in FIG. 27. The second cutting plane 610 is also perpendicular to the horizontal plane of the striking tool 10*c*. The first cutting plane 605 and the second cutting plane 610, thus, define 2 regions of the metallic head 80*c*. A first region Y is defined proximal to the striking surface 90*c*, the first region Y being that portion of the metallic head 80*c* that includes the striking surface 90*c* and is cut from the metallic head 80*c* along the first and second cutting planes. A second region Z is defined distal to the striking surface 90*c* and is that portion of the metallic head 80*c* that includes a claw 110*c* as depicted in FIG. 27 and is cut from the metallic head 80*c* by the first and second cutting planes. The first region Y and the second region Z define a head portion Y+Z of the striking tool 10*c* extending 2 inches down as measured from the center point 740, whereupon the shank 20*c* begins.

Figure 28:
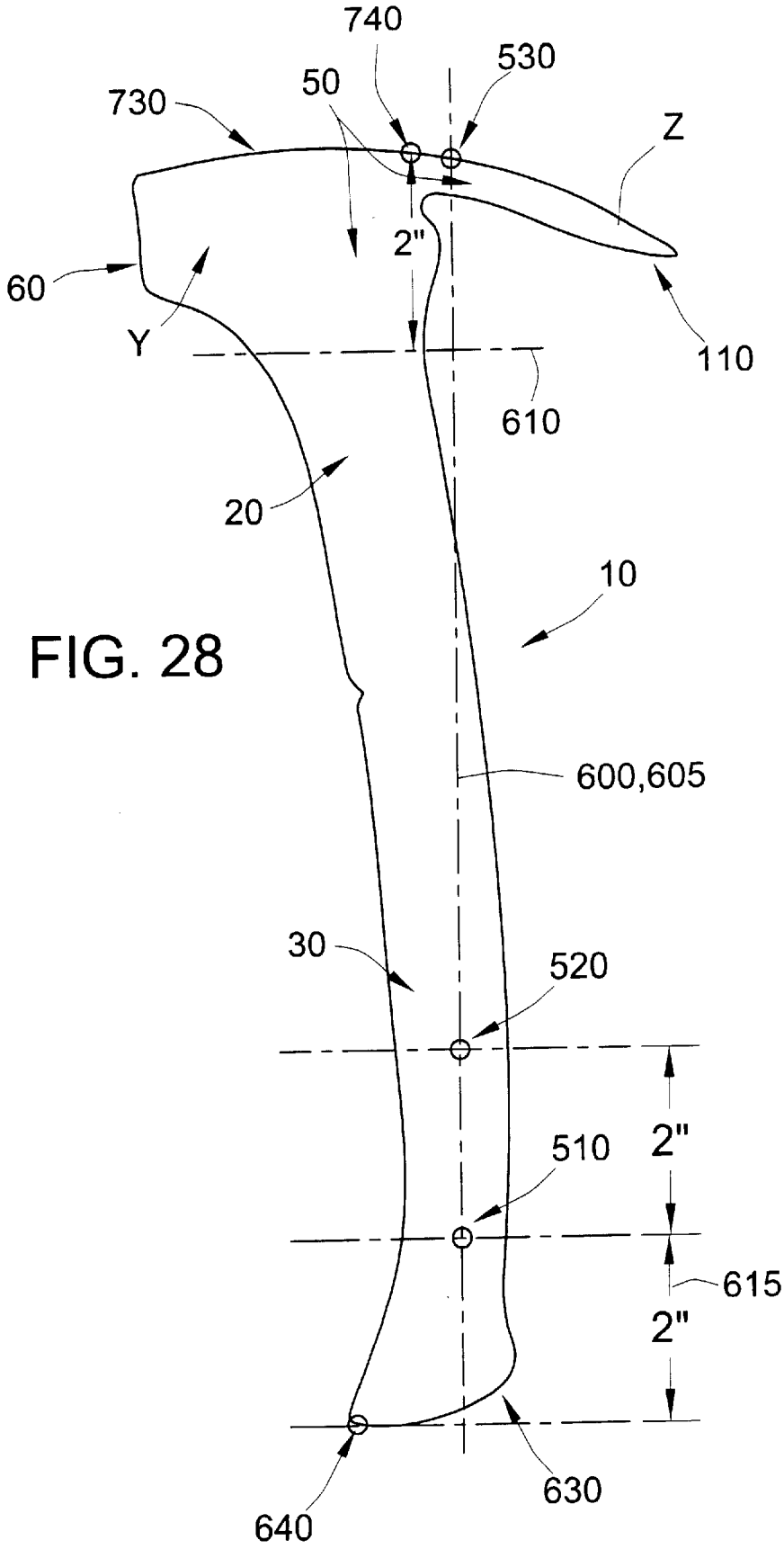
FIG. 28 illustrates another alternative embodiment of the present invention depicting the weight distribution of the striking tool head portion of the striking tool of the present invention.

FIG. 28 depicts an alternative embodiment of the striking tool 10 of the present invention (hereafter Embodiment B). A horizontal plane (not shown) is defined as the plane on which the striking tool 10 rests when laid on its side, such as when laid on a tabletop. The bottom surface of a handle 30 defines a bottom edge 630. The bottom edge 630 defines a bottommost point 640 distal to a striking surface 60. A first point 510 is positioned along the longitudinal center line of the handle 30 proximal to the bottommost point 640 of the handle 30. A second point 520 is located along the longitudinal center line of the handle 30 and is 2 inches vertically up the handle 30 as measured from the first point 510. A straight line 600 connects the first point 510 and the second point 520 and is extended to intersect a top edge point 530 of a metallic head 50. The vertical distance between the first point 510 and the bottommost point 640 is 2 inches as measured along a line 615 that is parallel to the line 600, as shown in FIG. 28. A first cutting plane 605 intersects the line 600 and is perpendicular to the horizontal plane (not shown) of the striking tool 10.

The top surface of the metallic head 50 defines a top edge 730. The top edge 730 defines a center point 740. A second cutting plane 610 is defined perpendicular to the first cutting plane 605 and intersects a shank 20 of the striking tool 10 2 inches below the second center point 740 as shown in FIG. 28. The second cutting plane 610 is also perpendicular to the horizontal plane of the striking tool 10. The first cutting plane 605 and the second cutting plane 610, thus, define 2 regions of the metallic head 50. A first region Y is defined proximal to the striking surface 60, the first region Y being that portion of the metallic head 50 that includes the striking surface 60 and is cut from the metallic head 50 along the first and second cutting planes. A second region Z is defined distal to the striking surface 60 and is that portion of the metallic head 50 that includes a claw 10 as depicted in FIG. 28 and is cut from the metallic head 50 by the first and second cutting planes. The first region Y and the second region Z define a head portion Y+Z of the striking tool 10 extending 2 inches down as measured from the center point 740, whereupon the shank 20 begins.

Tests were conducted to determine the weights of the first and second regions for embodiments of the present invention as compared to striking tools 10 of the prior art. The striking tools 10*c* of the prior art tested are depicted in FIGS. 15 through 27. Also depicted in FIGS. 15 through 27, are the first and second regions (Y and Z) for the respective prior art striking tools 10*c*. In Table 1 below, the weights of the respective first and second regions (Y and Z) are listed associated with the striking tool from which the respective cuts were made. Also shown in Table 1 below, is the percent by weight of the first region Y pared to the sum of the weights for the first and second regions Y+Z as shown in Table 1. The weight of the first region Y for Embodiment A of the present invention is 85% of the sum of the weights for the first and second regions. Whereas, the prior art striking tools exhibit no first region Y weights that are greater than 70% of the sum of the first and second region weights for any one striking tool. This data illustrates that substantially the weight of the metallic head of a striking tool 10 of the present invention is forward of the first cutting plane 605. The line 600, which is intersected by the first cutting plane 605, also defines an approximately vertical line when the striking tool 10 is held in a human hand in a normal use position. Thus, these data illustrate a substantial weight forward nature of the striking tools 10 of the present invention.

TABLE 1

| Hammer FIG. No. | Type | Head Portion Weight (Y + Z), lb. | Front Region Weight (Y), lb. | Y/Y + Z (%) |
|---|---|---|---|---|
| 15 | Prior art | 1.220 | .840 | 68.8 |
| 16 | Prior art | 1.250 | .790 | 63.2 |
| 17 | Prior art | 1.455 | .840 | 57.7 |
| 18 | Prior art | .745 | .505 | 67.8 |
| 19 | Prior art | 1.035 | .620 | 59.9 |
| 20 | Prior art | 1.090 | .710 | 65.1 |
| 21 | Prior art | .910 | .540 | 59.3 |
| 22 | Prior art | .980 | .550 | 56.1 |
| 23 | Prior art | 1.215 | .720 | 59.3 |
| 24 | Prior art | 1.170 | .695 | 59.4 |
| 25 | Prior art | 1.505 | .825 | 54.8 |
| 26 | Prior art | 1.465 | .795 | 54.3 |
| 27 | Prior art | 1.120 | .580 | 51.8 |
| 28 | Striking tool 10 Embodiment B | 1.160 | .915 | 78.9 |
| 14 | Striking tool 10 Embodiment A | 1.115 | .950 | 85.2 |

There has been provided in accordance with the principles of the present invention, a hand-held striking tool that reduces the effect of vibration during use when compared to striking tools of the prior art. There has also been provided in accordance with the principles of the present invention, a hand-held striking that has a weight center disposed forward of the gripping hand through the use of a curved shank, thus improving the efficiency of striking blow. There has further been provided in accordance with the principles of the present invention, a hand-held striking tool having a flange positioned beneath the head of the tool so that the effect of overstrike is better controlled when compared to devices of the prior art. While the invention has been described with specific embodiments and many alternatives, modifications and variations will be apparent to those skilled in the art in light of the foregoing description. Accordingly, it is intended to include all such alternatives, modifications and variations set forth within the spirit and scope of the appended claims.

What is claimed is:

1. A striking tool comprising:

a handle;

a head, the head defining a striking surface, the head further defining a weight center;

wherein the head includes an overstrike flange, and a generally curved shank connecting the handle to the head, the generally curved shank defining a curved centerline;

wherein the weight center is disposed between the curved centerline and the striking surface;

wherein a horizontal plane is defined as the plane on which the striking tool rests when laid flat on its side; and wherein a first cutting plane divides the striking tool along the length of the striking tool, wherein the fist cutting plane is perpendicular to the horizontal plane; and wherein a line which is intersected by the first cutting plane is defined by a first point positioned along a center line of the handle and a second point positioned along the center line of the handle, wherein the second point is vertically 2 inches up the handle as measured from the first point, and wherein the first point is separated by a vertical distance of 2 inches from a bottommost point, wherein the bottommost point is defined by a bottom edge of the handle, and wherein the bottommost point is intersected by a line that is parallel to the first cutting plane.

2. The striking tool of claim 1, wherein a top edge of the head defines a center point, wherein a second cutting plane which is perpendicular to the first cutting plane is disposed 2 inches down from the second center point.

3. The striking tool of claim 2, wherein a head portion is defined by the second cutting plane, and wherein the head portion is further divided by the fist cutting plane into a first region and a second region, wherein the first region is proximal to the striking surface, and wherein the second region is distal to the striking surface.

4. The striking tool of claim 3, wherein the weight of the first region is at least 70% of the sum of the weights of the first and second regions.

5. The striking tool of claim 3, wherein the weight of the first region is at least 78% of the sum of the weights of the first and second regions.

6. The striking tool of claim 3, wherein the weight of the first region is between 75 to 90% of the sum of the weights of the first and second regions.

* * * * *